US005180649A

United States Patent [19]

Kukimoto et al.

[11] Patent Number: 5,180,649

[45] Date of Patent: Jan. 19, 1993

[54] TONER HAVING CROSSLINKAGES AND METHOD OF FIXING SAME

[75] Inventors: Tsutomu Kukimoto, Tokyo; Hiroshi Yusa; Tsuyoshi Takiguchi, both of Yokohama; Koichi Tomiyama, Kawasaki; Tetsuhito Kuwashima, Yokohama, all of Japan

[73] Assignee: Canon Kabushiki Kaisha, Tokyo, Japan

[21] Appl. No.: 611,096

[22] Filed: Nov. 9, 1990

[30] Foreign Application Priority Data

Nov. 9, 1989 [JP] Japan ..... 1-289881
Nov. 9, 1989 [JP] Japan ..... 1-291796

[51] Int. Cl.[5] ..... G03G 9/083; G03G 13/20; G03G 9/087; G03G 9/097

[52] U.S. Cl. ..... 430/106.6; 430/109; 430/110; 430/111; 430/124

[58] Field of Search ..... 430/111, 109, 110, 124, 430/106.6

[56] References Cited

U.S. PATENT DOCUMENTS

| | | | |
|---|---|---|---|
| 2,297,691 | 10/1942 | Carlson . | |
| 2,890,968 | 6/1959 | Giaimo | 430/106.6 X |
| 3,124,483 | 3/1964 | Reinfrank | 430/106.6 X |
| 3,185,777 | 5/1965 | Rheinfrank | 430/107 |
| 3,345,294 | 10/1967 | Cooper | 430/106.6 X |
| 3,666,363 | 5/1972 | Tanaka et al. . | |
| 4,071,361 | 1/1978 | Marushima . | |
| 4,315,064 | 2/1982 | Miyakawa | 430/903 X |
| 4,357,406 | 11/1982 | Kouchi | 430/903 X |
| 4,702,986 | 10/1987 | Imai et al. | 430/120 |
| 4,939,060 | 7/1990 | Tomiyama et al. | 430/106.6 |

FOREIGN PATENT DOCUMENTS

| | | |
|---|---|---|
| 56-16144 | 2/1981 | Japan . |
| 57-178249 | 11/1982 | Japan . |
| 57-178250 | 11/1982 | Japan . |
| 59-214860 | 12/1984 | Japan . |
| 60-166958 | 8/1985 | Japan . |
| 61-110155 | 5/1986 | Japan . |
| 61-110156 | 5/1986 | Japan . |
| 63-214760 | 9/1988 | Japan . |
| 63-216063 | 9/1988 | Japan . |
| 63-217362 | 9/1988 | Japan . |
| 63-217363 | 9/1988 | Japan . |
| 63-217364 | 9/1988 | Japan . |
| 2101757B | 11/1984 | United Kingdom . |

*Primary Examiner*—Roland Martin
*Attorney, Agent, or Firm*—Fitzpatrick, Cella, Harper & Scinto

[57] ABSTRACT

A toner for developing electrostatic images is constituted from a binder resin, and a metal salt or a metal complex. Through the various interaction between the components, the toner is provided with unique visco-elastic properties including: a dynamic modulus $G'_{120-200}$ at 120°-200° C. of $2\times10^3$ or higher to below $5\times10^5$ [dyne/cm$^2$] as measured in the frequency range of $1\times10^{-2}$-1 (Hz); a loss modulus $G''_{120-200}$ at 120°-200° C. of $2\times10^3$ or higher to below $5\times10^5$ [dyne/cm$^2$] as measured in the frequency range of $1\times10^{-2}$-1 (Hz); a dynamic modulus $G'_{200}$ at 200° C. and a frequency f satisfying an approximated linear relationship according to the least squares method of: $\log G'_{200}=a\cdot\log\cdot f+\log b$, wherein a denotes a positive number of 0.25 or smaller and b denotes a constant; and a ratio $(G'_{200})/(G'_{120})$ of below 0.25 wherein $(G'_{200})$ denotes a dynamic modulus at 200° C. and $(G'_{120})$ denotes a dynamic modulus at 120° C. respectively at a frequency of 1 (Hz).

58 Claims, 8 Drawing Sheets

(EXAMPLE 1 TONER, AT 120°C)

(EXAMPLE I TONER, AT 200°C)

(EXAMPLE 1 TONER, AT 1Hz)

(EXAMPLE 1 TONER, AT 0.1Hz)

(EXAMPLE 5, MAGENETIC TONER, AT 120°C)

(EXAMPLE 5, MAGNETIC TONER, AT 200°C)

(EXAMPLE 5 TONER, AT 1Hz)

(EXAMPLE 5 TONER, AT 0.1Hz)

TONER HAVING CROSSLINKAGES AND METHOD OF FIXING SAME

FIELD OF THE INVENTION

The present invention relates to a toner for developing electrostatic images used in image forming methods such as electrophotography, particularly a toner which has been improved in respects of heat-fixability, anti-offset characteristic and developing performances for electrophotographic images. The present invention further relates to an image forming apparatus, an apparatus unit and a facsimile apparatus using such a specific toner.

Hitherto, a large number of electrophotographic processes have been known, inclusive of those disclosed in U.S. Pat. Nos. 2,297,691; 3,666,363; and 4,071,361. In these processes, in general, an electrostatic latent image is formed on a photosensitive member comprising a photoconductive material by various means, then the latent image is developed with a developer comprising a toner, and the resultant toner image is, after being transferred onto a transfer material such as paper etc., as desired, fixed by heating, pressing, or heating and pressing, or with solvent vapor to obtain a copy. The residual toner on the photosensitive member which being transferred is cleaned by various methods, and then the above steps are repeated.

In recent years, such as electrophotographic image forming apparatus has been used not only as a copying machine for office work but also as a digital printer as an outputting means for a computer and a facsimile machine and also a graphic copier for producing graphic copies of high definition.

For this reason, a strict reliability is required of such an image forming apparatus, and a toner used therefor is required to show high performances, without which an excellent apparatus is not provided.

Among the performances required of a toner for a digital printer or a copier for high definition images, fixability of thin line images is regarded as an important one.

As for the fixing step, various methods and apparatus have been developed, of which the most popular one is a heating and pressing fixation system using hot rollers.

In the heating and pressing system, a sheet carrying a toner image to be fixed (hereinafter called "fixation sheet") is passed through hot rollers, while a surface of a hot roller having a releasability with the toner is caused to contact the toner image surface of the fixation sheet under pressure, to fix the toner image. In this method, as the hot roller surface and the toner image on the fixation sheet contact each other under a pressure, very good heat efficiency is attained for melt-fixing the toner image onto the fixation sheet to afford quick fixation, so that the method is very effective in a high-speed electrophotographic copying machine. In this method, however, a toner image in a melted state is caused to contact a hot roller surface under pressure, so that there is observed a so-called offset phenomenon in which a part of the toner image is attached and transferred to the hot roller surface and then transferred back to the fixation sheet to stain the fixation sheet. It has been regarded as an essential condition in the hot roller fixation system to prevent the toner from sticking to the hot roller surface.

On the other hand, in a latent image for a high definition image part, electric lines of force are concentrated at a boundary between an exposed part and a non-exposed part to provide an apparent local increase in surface potential. Particularly in a digital printer, a latent image is composed of ON-OFF binary picture elements which causes an intensive concentration of electric lines of force at the boundary between an exposed part and a non-exposed part. Accordingly, the amount of toner attached to a unit area of a latent line image composed of picture elements in the development step is larger than that which forms an ordinary analog image. Accordingly, in the fixation of such an image, a toner having further better fixing and anti-offset characteristics is required at present.

A printer is generally used to provide 3–5 times as many copies as prepared by a copying machine of the same level and requires a toner having further better fixing and anti-offset performances.

As for the improvement of the binder resin for a toner, a toner using a crosslinked polymer as the binder resin has been proposed, e.g., in Japanese Patent Publication JP-B 51-23854. Such a toner using a crosslinked polymer shows improved an anti-offset characteristic and anti-winding characteristic but exhibits an increased fixing temperature as the degree of crosslinking is increased. Accordingly, it is difficult to have a toner showing a low fixing temperature, good anti-offset and anti-winding characteristic and also good fixability. In order to improve the fixability, it is generally required to use a lower molecular-weight binder resin having a lower softening point. This is contradictory to an improvement in anti-offset characteristic. Further, a lowering in glass transition point for providing a low softening point leads to an undesirable phenomenon of toner blocking during storage.

Further, as a toner comprising a low-molecular weight polymer and a crosslinked polymer, JP-A 58-86558 for example has proposed a toner comprising a low-molecular weight polymer and a non-fusible polymer as principal resin components. According to the teaching, the fixability actually tends to be improved, but it is difficult to satisfy the fixability and the anti-offset characteristic at high performances because the weight-average molecular weight/number-average molecular weight ratio (Mw/Mn) is as low as 3.5 or below and the non-fusible polymer content is as much as 40–90 wt. %. Actually, it has been very difficult to provide a toner with sufficient fixability and anti-offset characteristic unless it is used in a fixing device equipped with a means for supplying an offset-preventing liquid.

JP-A 60-166958 has proposed a toner comprising a resin component prepared by polymerization in the presence of a low-molecular weight poly-$\alpha$-methylstyrene having a number-average molecular weight (Mn) of 500–1,500. The same patent specification describes that an Mn range of 9,000–30,000 is preferred but a higher Mn for improving the anti-offset characteristic leads to a practical problem in fixability.

JP-A 56-16144 has proposed a toner comprising a binder resin having at least a maximum in each of the molecular weight ranges of $10^3$14 $8\times10^4$ and $10^5$–$2\times10^6$ in the molecular weight distribution according to GPC (gel permeation chromatography). The toner exhibits excellent performances in respects of pulverizability, anti-offset characteristic, fixability, anti-filming or anti-melting characteristic on a photosensitive member and image forming characteristic but further improvement in anti-offset characteristic and fixability is desired.

On the other hand, as for physical properties required of a toner, several proposals have been made with respect to binder resins including: crosslinking by reaction of a polymer comprising a carboxylic acid with a metal compound (JP-A 57-178249, JP-A 57-178250, etc.) and reaction of a binder comprising a vinyl monomer and a specific half-ester compound as essential composition units with a polyvalent metal compound to cause crosslinking with the metal (JP-A 61-110155, JP-A 61-110156).

Further, JP-A 63-214760, JP-A 63-217362, JP-A 63-217363 and JP-A 63-217364 disclose reaction of a polymer having a molecular weight distribution including two portions of a low-molecular weight portion and a high-molecular weight portion with the low-molecular weight portion including a carboxyl group and a polyvalent metal ion to cause crosslinking (more specifically adding a liquid dispersion of a metal compound into a solution after solution polymerization, followed by heating for the reaction). In any method, however, the reaction between the binder resin and the metal compound or the dispersion of the metal compound in the binder resin is not sufficient, so that the physical properties required of a toner, particularly the fixing characteristic and the anti-offset characteristic, are not satisfied. Further, as the metal compound in a large amount is formulated with the binder resin, the metal compound can show a catalytic action to the binder resin depending on the condition to cause gellation of the binder resin. Accordingly, it is difficult to determine the production condition for formulating the metal compound to obtain a desired toner. Even if the production conditions are determined, it is difficult to produce a toner with a good reproducibility.

Even if a binder resin contains a carboxyl group capable of reacting with a metal compound, its crosslinking reactivity is weak if the carboxyl group is in the form of an anhydride structure (i.e., a closed ring structure). As a result, the crosslinking intensity becomes insufficient, thus failing to provide satisfactory anti-offset characteristic and fixability.

Further, JP-A 63-216063 proposes the combination of ionic crosslinking with a metal in the binder resin and an offset-preventing agent, and JP-A 62-280757 proposes reaction of an acid anhydride group and a cationic component to form a polar functional group in the binder resin to improve the charging characteristic of a toner. These proposals however have not provided a toner with all required properties, such as anti-offset characteristic, fixability and developing characteristic.

JP-A 59-214860 proposes a toner comprising a resin having a specific range of viscoelasticity for improvement in fixing characteristic and anti-offset characteristic. This toner shows some effect in respect of anti-offset characteristic, however, the combination of a low-temperature fixability and the anti-offset characteristic have been unsatisfactory because of too high elasticity and viscosity and too high a frequency-dependence thereof.

JP-A 63-223662 discloses a binder resin having a THF-insoluble content of 10–60 parts and a THF-soluble content showing two peaks in its molecular weight distribution for improved anti-offset characteristic. However, further improved low-temperature fixability, anti-blocking characteristic and anti-offset characteristic are desired so as to be applicable to both high-speed and low-speed image forming apparatus.

As described above, there has been demanded a toner having satisfactory fixing performance and anti-offset characteristic which is particularly suitable for development of digital latent images.

SUMMARY OF THE INVENTION

A general object of the present invention is to provide a toner having solved the above mentioned problems.

A more specific object of the invention is to provide a toner showing excellent fixability and anti-offset characteristic, as well as good image reproducibility and freedom from reversal fog.

An object of the invention is to provide a toner free from image degradation even after long use.

An object of the invention is to provide a toner which is fixable at a low temperature, has an excellent anti-blocking characteristic and is suitably used in a high temperature environment in a small-sized copying machine.

An object of the invention is to provide a toner which has an excellent anti-offset characteristic and also a good reproducibility.

An object of the invention is to provide a toner which provides a high image density, an excellent thin-line reproducibility, and a good gradation characteristic.

An object of the invention is to provide a toner which stably retains a high image density without being affected by environmental changes.

An object of the invention is to provide an image forming apparatus using such a specific toner.

An object of the invention is to provide an apparatus unit using such a specific toner.

An object of the present invention is to provide a facsimile apparatus using such a specific toner.

According to a principal aspect of the invention, there is provided a toner for developing electrostatic images, comprising a binder resin, and a metal salt or a metal complex; wherein the toner has:

a dynamic modulus $G'_{120-200}$ at 120–200° C. of $2\times10^3$ or higher to below $5\times10^5$ [dyne/cm$^2$] as measured in the frequency range of $1\times10^{-2}$–1 (Hz);

a loss modulus $G''_{120-200}$ at 120–200° C. of $2\times10^3$ or higher to below $5\times10^5$ [dyne/cm$^2$] as measured in the frequency range of $1\times10^{-2}$–1 (Hz);

a dynamic modulus $G'_{200}$ at 200° C. and a frequency f satisfying an approximated linear relationship according to the least squares method of:

$$\log G'_{200} = a \cdot \log f + \log b,$$

wherein a denotes a positive number of 0.25 or smaller and b denotes a constant; and a ratio $(G'_{200})/(G'_{120})$ of below 0.25 wherein $(G'_{200})$ denotes a dynamic modulus at 200° C. and $(G'_{120})$ denotes a dynamic modulus at 120° C. respectively at a frequency of 1 (Hz).

According to another aspect of the invention, there is provided an image forming apparatus, comprising: an electrostatic latent image-bearing member, and a developing device comprising a developer-carrying member for carrying a toner for developing the electrostatic latent image at a developing station and conveying the toner to the developing station, and a developer container for containing the toner; wherein the toner comprises a binder resin, and a metal salt or a metal complex; wherein the toner has:

a dynamic modulus $G'_{120-200}$ at 120–200° C. of $2\times10^3$ or higher to below $5\times10^5$ [dyne/cm$^2$] as measured in the frequency range of $1\times10^{-2}$–1 (Hz);

a loss modulus $G''_{120-200}$ at 120–200° C. of $2\times10^3$ or higher to below $5\times10^5$ [dyne/cm$^2$] as measured in the frequency range of $1\times10^{-2}$–1 (Hz);

a dynamic modulus $G'_{200}$ at 200° C. and a frequency f satisfying an approximated linear relationship according to the least squares method of:

$$\log G'_{200}=a\cdot\log f+\log b,$$

wherein a denotes a positive number of 0.25 or smaller and b denotes a constant; and a ratio $(G'_{200})/(G'_{120})$ of below 0.25 wherein $(G'_{200})$ denotes a dynamic modulus at 200° C. and $(G'_{120})$ denotes a dynamic modulus at 120° C. respectively at a frequency of 1 (Hz).

According to another aspect of the invention, there is provided an apparatus unit, comprising: an electrostatic latent image-bearing member and a developing device for developing the electrostatic latent image at a developing station; the developing device comprising a developer container for containing the toner, and a developer-carrying member for carrying the toner and conveying the toner to the developing station;

wherein the toner comprises a binder resin, and a metal salt or a metal complex; wherein the toner has:

a dynamic modulus $G'_{120-200}$ at 120–200° C. of $2\times10^3$ or higher to below $5\times10^5$ [dyne/cm$^2$] as measured in the frequency range of $1\times10^{-2}$–1 (Hz);

a loss modulus $G''_{120-200}$ at 120–200° C. of $2\times10^3$ or higher to below $5\times10^5$ [dyne/cm$^2$] as measured in the frequency range of $1\times10^{-2}$–1 (Hz);

a dynamic modulus $G'_{200}$ at 200° C. and a frequency f satisfying an approximated linear relationship according to the least squares method of:

$$\log G'_{200}=a\cdot\log f+\log b,$$

wherein a denotes a positive number of 0.25 or smaller and b denotes a constant; and a ratio $(G'_{200})/(G'_{120})$ of below 0.25 wherein $(G'_{200})$ denotes a dynamic modulus at 200° C. and $(G'_{120})$ denotes a dynamic modulus at 120° C. respectively at a frequency of 1 (Hz);

wherein said developing device is supported integrally together with the image-bearing member to form a single unit, which can be connected to or released from an apparatus body as desired.

According to another aspect of the invention, there is provided a facsimile apparatus, comprising: an electrophotographic apparatus and a receiving means for receiving image data from a remote terminal, wherein said electrophotographic apparatus comprises: an image-bearing member for bearing a latent image, and a developing device for developing the latent image, the developing device comprising:

a developer container for containing a toner wherein the toner comprises a binder resin, and a metal salt or a metal complex; wherein the toner has:

a dynamic modulus $G'_{120-200}$ at 120–200° C. of $2\times10^3$ or higher to below $5\times10^5$ [dyne/cm$^2$] as measured in the frequency range of $1\times10^{-2}$–1 (Hz);

a loss modulus $G''_{120-200}$ at 120–200° C. of $2\times10^3$ or higher to below $5\times10^5$ [dyne/cm$^2$] as measured in the frequency range of $1\times10^{-2}$–1 (Hz);

a dynamic modulus $G'_{200}$ at 200° C. and a frequency f satisfying an approximated linear relationship according to the least squares method of:

$$\log G'_{200}=a\cdot\log f+\log b,$$

wherein a denotes a positive number of 0.25 or smaller and b denotes a constant; and a ratio $(G'_{200})/(G'_{120})$ of below 0.25 wherein $(G'_{200})$ denotes a dynamic modulus at 200° C. and $(G'_{120})$ denotes a dynamic modulus at 120° C. respectively at a frequency of 1 (Hz).

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
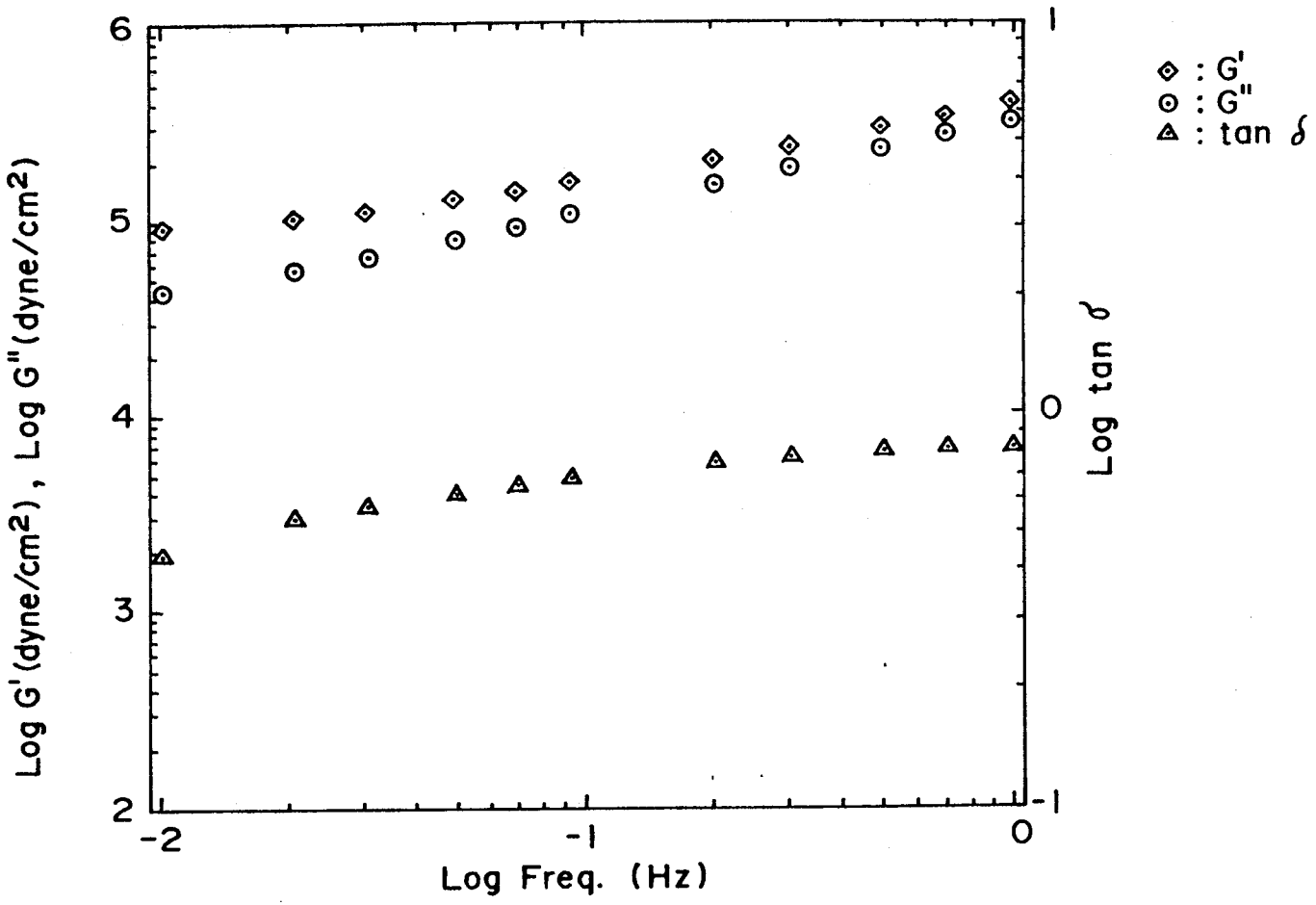
FIG. 1 is a graph showing the frequency-dependence (0.01 Hz–1 Hz) of the viscoelasticity at 120° C. of the toner according to Example 1.

It is a characteristic feature of the toner according to the present invention that the toner has a dynamic modulus $G'_{200}$ at frequencies f satisfying an approximated linear relationship according to the least squares method of:

$$\log G'_{200}=a\cdot\log f+\log b,$$

wherein a denotes a positive number of 0.25 or smaller.

The value a corresponds to the slope of a line represented by the above equation on a double-logarithmic scale graph, and a larger |a| (absolute value of a) means a large change in G' according to a frequency change. As a frequency change can be converted into a temperature change according to the time-temperature conversion rule, the relationship can be said in a different expression that a larger |a| leads to a larger change in G' corresponding to a temperature change.

The thermal characteristic of a toner is significantly related to the fixability. For exhibiting a fixability, a toner is required to be softened so as to be sufficiently deformed when it is passed through hot rollers under pressure but not softened excessively so as not to cause a high-temperature offset. Further, the elasticity modulus of the toner is required not to cause too large a change according to a change in temperature so as to provide stable fixing and anti-offset characteristics. As the toner according to the present invention has a dynamic modulus G'(or $G1)_{120-200}$ at 120–200° C. and a loss modulus G''(or $G2)_{120-200}$ at 120–200° C. of respectively in the range of $2\times10^3$ to below $5\times10^5$ dyne/cm$^2$ as measured in the frequency f range of $1\times10^{-2}$–1 Hz, a good fixability is exhibited without causing high-temperature offset at the time of fixing. Further, as the value a in the equation showing an approximated linear relationship is a positive number of 0.25 or smaller, the toner shows a moderate change in elasticity modulus according to a change in temperature at 200° C. or higher, so that it shows stable fixing and anti-offset characteristics even if there is some fluctuation in temperature along the rollers at the time of fixation.

The dynamic modulus and loss modulus of the toner according to the present invention does not substantially change with time at 200° C. so that, even if the toner recovered by cleaning by a fixing device cleaning member is subjected to heat from the fixing rollers for a long time, the recovered toner or developer does not cause a problem of leaking out from the cleaning member.

In case where a toner showing a $G'_{120-200}$ below $2\times10^3$ [dyne/cm$^2$] is used, the anti-offset characteristic is insufficient, and in case where a toner showing a $G'_{120-200}$ exceeding $5\times10^5$ [dyne/cm$^2$] is used, the low-temperature fixability is insufficient.

The viscoelasticity characterizing the toner of the invention may be measured by means of a rheometer ("IR-200", made by Iwamoto Seisakusho K.K.) equipped with 3 cm-dia. parallel plates.

The toner according to the present invention has a ratio ($G'_{200}/G'_{120}$) of below 0.25 (and preferably 0.05 or above) based on the dynamic moduli ($G'_{120}$) at 120° C. and ($G'_{200}$) at 200° C. at the same frequency (particularly at 1 Hz) in the range of $1\times10^{-2}$–1 Hz, and because of this characteristic in combination with the above-mentioned viscoelastic properties, the toner exhibits sufficient low-temperature fixability, anti-offset characteristic and anti-blocking characteristic in combination.

While various factors are related with the above-mentioned viscoelastic properties of the toner according to the invention, it is preferred that the toner comprises a binder resin as described below.

More specifically, it is preferred that the binder resin in the toner of the invention contains a THF (tetrahydrofuran)-soluble content showing a molecular weight distribution in a GPC chromatogram including at least one peak in the molecular weight region of from 2,000 to below 15,000 and at least a peak or shoulder in the molecular weight region of 15,000 to 100,000, contains polymerized units of a carboxyl group-containing monomer or carboxylic acid derivative monomer, and has a JIS-acid value (A) measured according to JIS K-0070 and a total acid value (B) measured after hydrolysis of the acid anhydride group in the resin which provide a ratio (A/B) in the range of 0.75–0.99.

The binder resin may preferably contain 5–70 wt. parts, further preferably 20–60 wt. parts, of a THF-insoluble content per 100 wt. parts of the resin.

When a binder resin is dissolved in a solvent, such as THF, it is divided into a soluble content and an insoluble content. The soluble content can be subjected to measurement of the molecular weight distribution. When attention is paid to the quantity of the THF-insoluble content and the position of a peak in the molecular weight distribution of the THF-soluble content, a binder resin containing no or little THF-insoluble content is very disadvantageous in respect of pulverizability in production of a toner through pulverization. An attempt of improving the pulverizability by simply shifting the position of a peak in the molecular weight distribution of the THF-soluble content on the lower molecular weight side results in inferior anti-offset characteristic. This proves that it is difficult to satisfy the anti-offset characteristic and the pulverizability in combination.

As may be understood from this study, it is very effective to have the binder resin contain a certain amount of THF-insoluble content not only for improving the anti-offset characteristic as is generally contemplated but also for improving the pulverizability.

From further study on the molecular weight distribution of the THF-soluble content, the property regarding the level (high or low) of fixable temperature (hereinafter simply referred to as "fixability"), the anti-offset characteristic, the pulverizability, and the anti-blocking characteristic, it has been understood that, in a binder resin, the THF-insoluble content has a major influence on the anti-offset characteristic, the anti-blocking characteristic and the pulverizability of a kneaded and cooled product at the time of toner production; the portion having a molecular weight of below 15,000 of the THF-soluble content has a major influence on the pulverizability and melt-sticking onto the inner wall of the pulverizer of the kneaded and cooled product at the time of toner production, the anti-blocking characteristic, the melt-sticking onto a photosensitive member and the filming; and the portion having a molecular weight of 15,000 or above of the THF-soluble content has a major influence on the anti-offset characteristic and the fixability.

More specifically, the binder resin used in the toner of the present invention may preferably have a THF-insoluble content (gel content) of 5–70 wt. %, particularly 20–60 wt. %,(based on the binder resin), contain the remainder of THF-soluble content providing a GPC chromatogram showing at least one peak in the molecular weight range of 2,000 to below 15,000, particularly 3,000–12,000, and at least one peak or shoulder in the molecular weight range of 15,000–10,000, particularly 20,000–70,000. It is further preferred that the peak in the molecular weight range of 2,000 to below 15,000 and the peak or shoulder in the molecular weight range of 100,000 has a molecular weight difference of 5,000 or more, particularly 10,000 or more.

If the THF-insoluble content in the binder resin exceeds 70%, the fixing temperature tends to increase and dispersion of additives in the binder resin tends to become worse. Further, a highly crosslinked portion is liable to be severed at the time of kneading of the resin to cause an adverse effect to toner designing. If the THF-insoluble content is below 5%, the toner is liable to cause offsetting and winding about a roller. In case where the THF-insoluble content is below 5% and a large content of high molecular weight portion is contained, the pulverizability is liable to be remarkably impaired. If the THF-soluble content lacks a peak in the molecular weight range of 2,000 to below 15,000 but has a peak in the molecular weight range of 15,000 or above, the resultant toner is liable to have an increased fixing temperature, a narrow fixable temperature region and worse pulverizability to result in a lower productivity. If the peak molecular weight is below 2,000, the resultant toner can have a remarkably poor anti-offset characteristic and a poor anti-blocking characteristic. If the peak or shoulder on the other molecular weight region is not in the range of 15,000–100,000 but has a value of over 100,000, there is a tendency that the dispersibility of the additives becomes worse, the fixing temperature increases remarkably and the pulverizability becomes remarkably worse. If the peak or shoulder is below 15,000, the resultant toner can have a poor anti-offset characteristic and a problem in respect of blocking.

Further, in order to fully satisfy the anti-offset characteristic, it is preferred that the binder resin not only has an increased THF-insoluble content and an increased proportion of THF-soluble content having a molecular weight of 15,000 or higher but also contains a metal compound and a carboxyl group capable of causing a crosslinking reaction with each other. It is further preferred that the carboxyl group is disposed to be able to form an anhydride group in the molecule so as be rich in capability of crosslinking reaction with a metal compound.

The crosslinking is promoted by heat, and a part of the carboxyl groups is involved in crosslinking reaction with a metal compound and another part of the carboxyl groups is converted into anhydride groups at the time of melt-kneading for toner production.

Since most carboxyl groups in the binder resin are involved in these reactions, the resultant toner is free from or hardly accompanied with difficulties in respect of chargeability due to environmental conditions, represented by a decrease in chargeability of a toner due to moisture absorption under high temperature-high humidity conditions, peculiar to a toner using a binder resin containing a carboxyl group. The conversion of carboxyl group into anhydride groups is advantageous in respect of providing the binder resin per se with a sufficient negative chargeability which can lead to a good negative chargeability of the resultant toner.

Further, even if most carboxyl groups are involved in crosslinking or converted into anhydride groups, the intense polarity of the binder resin is retained, so that the resultant toner has a good affinity to paper and a further improved fixability. Accordingly, it is also possible to provide an increased Tg (glass transition point) of the binder resin and also an improved anti-blocking characteristic.

In order for the toner of the present invention to have a dynamic modulus $G'_{120-200}$ of $2\times10^3$ to below $5\times10^5$ as measure at 120–200° C. in the frequency range of $1\times10^{-2}$ [Hz]–1 [Hz], it is preferred to use a binder resin satisfying the above features.

When a copolymer having polymerized units of such carboxyl group-containing monomers or a composition containing such a copolymer is subjected to suspension polymerization, a part of the carboxylic anhydride groups are hydrolyzed to provide a mixture of dicarboxylic groups, carboxyl groups and carboxylic anhydride groups.

These three types of acidic groups in the copolymer or its composition are considered to form various types of polymer complex through interaction with metal ions from a metal salt or metal complex as another component of the toner according to the invention.

Accordingly, the toner binder resin of the present invention is provided with metallic crosslinkages (i.e., ionic crosslinkages by the medium of metal elements) due to such various polymer complexes showing different bonding strengths and also strong crosslinkages due to polymerizable crosslinking agent. Because of mixing of various crosslinkages showing different crosslinking strengths, a toner having the above-mentioned unique viscoelastic properties is provided to show excellent anti-blocking characteristic as well as excellent low-temperature fixability and anti-offset characteristic.

If a low-molecular weight polymer or copolymer having dicarboxylic units is crosslinked with a metal ion, the anti-blocking characteristic of the toner can be improved without increasing the Tg of the polymer or copolymer. As the Tg need not be increased in order to improve the anti-blocking characteristic, it is possible to render the dynamic modulus and loss modulus measured at 120° C. to be below $5\times10^5$ dyne.cm$^2$.

In case where a polymer or copolymer having a high Tg is used to increase the anti-blocking characteristic, the dynamic modulus and loss modulus at 120° C. become $5\times10^5$ dyne.cm$^2$ or above, and it becomes difficult to accomplish low-temperature fixation.

Further, as crosslinkages having various bonding strengths are present in the polymer or copolymer, the dynamic modulus and loss modulus at 200° C. can be maintained at $2\times10^3$ dyne.cm$^2$ or higher, and the frequency-dependence of the modulus $G'_{200}$ to 200° C. measured in the frequency range of $1\times10^{-2}$–1 [Hz] can be made extremely small.

As the toner according to the present invention contains crosslinkages showing various bonding strengths in the binder resin as described above, the dynamic modulus and loss modulus at 200° C. thereof shows substantially no change with time. Herein, "substantially no change with time" means that, when the toner is held at 200° C. for a period of 1 hour, the measured values of the dynamic modulus and loss modulus during the period are within the range of 0.8–1.8 times, preferably 0.9–1.5 times, those measured at the initial stage.

If the measured values of the dynamic modulus and loss modulus are below 0.8 times the initial values, the toner is liable to leak out from the cleaning member for the fixing device (roller). If they are above 1.8 times the initial values, the fixing device is liable to be damage when the fixing device is held at a high temperature for a long period.

As described above, in the present invention, the carboxyl group content, particularly the content of dicarboxylic group or its derivative, in the binder resin has a great influence on the visco-elasticity of the toner, and it is preferred to use a binder resin having a JIS-acid value (A) measured according to JIS K-0070 and a total acid value (B) measured after hydrolysis of the acid anhydride group in the binder resin which provide a ratio (A/B) in the range of 0.75–0.99. The binder resin may preferably be melt-kneaded together with a metal salt or complex.

If the ratio (A/B) is below 0.75, the acid anhydride content is excessive to provide an insufficient increase in anti-blocking characteristic, thus being difficult to the viscoelastic properties required by the present invention.

If the ratio A/B exceeds 0.99, almost no acid anhydride groups are contained so that the chargeability of the toner is liable to be instable, thus causing a problem in image quality.

The total acid value (B) of a binder resin used herein is measured in the following manner. A sample resin in an amount of 2 g is dissolved in 30 ml of dioxane, and 10 ml of pyridine, 20 mg of dimethylaminopyridine and 3.5 ml of water are added thereto, followed by 4 hours of heat refluxing for 4 hours. After cooling, the resultant solution is titrated with 1/10 N-KOH solution in THF (tetrahydrofuran) to neutrality with phenolphthalein as the indicator to measure the acid value, which is a total acid value (B).

The above-mentioned 1/10 N-KOH solution in THF is prepared as follows. First, 1.5 g of KOH is dissolved in about 3 ml of water, and 200 ml of THF and 30 ml of water are added thereto, followed by stirring. After standing, a uniform clear solution is formed, if necessary, by adding a small amount of methanol if the solution is separated or by adding a small amount of water if the solution is turbid. Then, the factor of the 1/10 N-KOH/THF solution thus obtained is standardized by a 1/10 N-HCl standard solution.

The acid value measurement according to JIS K-0070 is generally as follows.

Reagents as described below are used.

(a) A solvent is prepared as an ethyl ether/ethyl alcohol mixture (1/1 or 2/1) or a benzene/ethyl alcohol mixture (1/1 or 2/1). The solvent is neutralized with a 1/10 N-KOH ethyl alcohol solution with phenolphthalein as the indicator.

(b) A phenolphthalein solution is prepared by dissolving 1 g of phenolphthalein in 100 ml of ethyl alcohol (95 V/V %).

(c) A N/10-KOH ethyl alcohol solution is prepared by 7.0 g of potassium hydroxide in as small an amount as possible and ethyl alcohol (95 V/v %) is added thereto to form 1 l of a mixture, which is caused to stand for 2–3 days and filtrated. The solution is standardized according to JIS K 8006 (Fundamentals relating to titration among quantitative tests of reagents).

The JIS acid value is measured as followed by using the reagents.

A sample is accurately weighed, and 100 ml of the solvent and several drops of the phenolphthalein solution as the indicator are added thereto, followed by sufficient shaking until the sample is completely dissolved In case of a solid sample, it is dissolved by warming on a water bath. After cooling, the solution is titrated with the N/10 KOH/ethyl alcohol solution until an end point which is judged by continuation of thin red color of the indicator for 30 seconds. The acid value A is calculated by the following equation:

$$A=(B\times f\times 5.611)/S,$$

wherein B: amount(ml) of the N/10-KOH/ethyl alcohol solution, f: factor of the N/10-KOH/ethyl alcohol solution, and S: sample weight(g).

While the JIS acid value (A) and the total acid value (B) may conveniently be performed by using the binder resin alone, it has been confirmed that substantially the same values are obtained with respect to the toner according to the present invention using the binder resin.

Herein, the THF-insoluble content refers to a polymer component (substantially a crosslinked polymer component) which is insoluble in solvent THF (tetrahydrofuran) in the resin composition (binder resin) constituting a toner, and it may be used as a parameter for indicating the degree of crosslinking of the resin composition containing a crosslinked component.

The THF-insoluble content may be defined as a value obtained in the following manner.

0.5–1.0 g of a toner sample is weighed ($W_1$g) and placed in a cylindrical filter paper (e.g., No. 86R available from Toyo Roshi K.K.) and then subjected to extraction with 100 to 200 ml of solvent THF by using a Soxhlet's extractor for 6 hours. The soluble content extracted with the solvent THF is recovered by evaporation and dried for several hours at 100° C. under vacuum to measure a weight ($W_2$g) of the THF-soluble content. On the other hand, the weight ($W_3$g) of the components, such as the magnetic material and/or pigment, other than the resin component in the toner is separately measured. Then, the THF-insoluble content is given by the following equation:

$$\textit{THF-insoluble content}\ (\%)=[W_1-(W_2+W_3)]/[W_1-W_3]\times 100$$

The GPC (gel permeation chromatography) measurement and identification of molecular weight corresponding to the peaks and/or shoulders may be performed under the following conditions.

A column is stabilized in a heat chamber at 40° C., tetrahydrofuran (THF) solvent is caused to flow through the column at that temperature at a rate of 1 ml/min., and 50–200 μl of a sample resin solution in THF at a concentration of 0.05–0.6 wt. % is injected. The identification of sample molecular weight and its molecular weight distribution is performed based on a calibration curve obtained by using several monodisperse polystyrene samples and having a logarithmic scale of molecular weight versus count number. The standard polystyrene samples for preparation of a calibration curve may be those having molecular weights of, e.g., $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$ available from, e.g., Pressure Chemical Co. or Toyo Soda Kogyo K.K. It is appropriate to use at least 10 standard polystyrene samples. The detector may be an RI (refractive index) detector.

For accurate measurement of molecular weights in the range of $10^3$–$4\times10^6$, it is appropriate to constitute the column as a combination of several commercially available polystyrene gel columns. A preferred example thereof may be a combination of μ-styragel 500, $10^3$, $10^4$ and $10^5$ available from Waters Co.; a combination of Shodex KF-80M, 802, 803, 804 and 805; or a combination of TSK gel G1000H, G2000H, G2500H, G3000H, G4000H, G5000H, G6000H, G7000H and GMH available from Toyo Soda K.K.

The content of a component having a molecular weight of 10,000 or below in the binder resin is measured by cutting out a chromatogram of the corresponding molecular weight portion and calculating a ratio of the weight thereof with that of the chromatogram covering the molecular weight range of 10,000 or higher, to derive the weight % thereof in the whole binder resin including the above-mentioned THF-insoluble content.

Examples of the polymerizable monomer containing a carboxylic acid group usable in the invention may include: α,β-unsaturated carboxylic acids, such as acrylic acid and methacrylic acid; α,β-unsaturated dicarboxylic acids, such as maleic acid and fumaric acid, and their half esters; alkenyldicarboxylic acids, such as n-butenylsuccinic acid and n-butenyladipic acid, and their half esters.

Examples of the half esters of the dicarboxylic acids usable in the invention may include: half esters of α,β-unsaturated dicarboxylic acids, such as monomethyl maleate, monoethyl maleate, monobutyl maleate, monooctyl maleate, monoallyl maleate, monophenyl maleate, monomethyl fumarate, monoethyl fumarate, monobutyl fumarate, and monophenyl fumarate; half esters of alkenyl-dicarboxylic acids, such as monobutyl n-butenylsuccinate, monomethyl n-octenylsuccinate, monoethyl n-butenylmalonate, monomethyl n-dodecenylglutarate, and monobutyl n-betenyladipate; and half esters of aromatic dicarboxylic acids, such as monomethyl phthalate, monoethyl phthalate, and monobutyl phthalate.

The above-mentioned half-ester of a dicarboxylic acid may preferably be added in a proportion of 1–30 wt. %, more preferably 3–20 wt. %, of the total monomer constituting the binder resin.

A half-ester of a dicarboxylic acid as described above may preferably be used in combination with suspension polymerization as a preferred process for production of a binder resin. This is because, in the suspension polymerization system, an acid monomer having a high solubility in an aqueous dispersion medium is not appropriately used but a monomer in the form of an ester having a low solubility is preferred.

In order to produce vinyl copolymers with the above-mentioned polymerizable monomer containing a carboxylic acid group, and also produce another binder resin component, another vinyl monomer may be used, examples of which may include: styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tertbutylstyrene, p-n-hexylstyrene, p-n-octylstyrene, p-n-nonylstyrene, p-n-decylstyrene, and p-n-dodecylstyrene; ethylenically unsaturated monoolefins, such as ethylene, propylene, butylene, and isobutylene; unsaturated polyenes, such as butadiene; halogenated vinyls, such as vinyl chloride, vinylidene chloride, vinyl bromide, and vinyl fluoride; vinyl esters, such as vinyl acetate, vinyl propionate, and vinyl benzoate; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacryronitrile, and acrylamide; the esters of the above-mentioned α, β-unsaturated acids and the diesters of the above-mentioned dibasic acids. These vinyl monomers may be used singly or in combination of two or more species.

Among these, a combination of monomers providing styrene-type copolymers and styrene-acrylic type copolymers may be particularly preferred.

It is significant in the present invention that the binder resin according to the present invention is a crosslinked polymer obtained by using a crosslinking monomer which may be a monomer having two or more polymerizable double bonds. Examples thereof may be enumerated as follows.

Aromatic divinyl compounds, such as divinylbenzene and divinylnaphthalene; diacrylate compounds connected with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and compounds obtained by substituting methacrylate groups for the acrylate groups in the above compounds; diacrylate compounds connected with an alkyl chain including an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds obtained by substituting methacrylate groups for the acrylate groups in the above compounds; diacrylate compounds connected with a chain including an aromatic group and an ether bond, such as polyoxyethylene(2)-2,2-bis(4-hydroxyphenyl)propanediacrylate, polyoxyethylene(4)-2,2-bis(4-hydroxyphenyl)propanediacrylate, and compounds obtained by substituting methacrylate groups for the acrylate groups in the above compounds; and polyester-type diacrylate compounds, such as one known by a trade name of MANDA (available from Nihon Kayaku K.K.). Polyfunctional crosslinking agents, such as pentaerythritol triacrylate, trimethylethane triacrylate, tetramethylolmethane tetracrylate, oligoester acrylate, and compounds obtained by substituting methacrylate groups for the acrylate groups in the above compounds; triallyl cyanurate and triallyl trimellitate.

These crosslinking agents may preferably be used in a proportion of about 0.01–5 wt. parts, particularly about 0.03–3 wt. parts, per 100 wt. parts of the other vinyl monomer components.

Among the above-mentioned crosslinking monomers, aromatic divinyl compounds (particularly, divinylbenzene) and diacrylate compounds connected with a chain including an aromatic group and an ether bond may suitably be used in a toner resin in view of fixing characteristic and anti-offset characteristic.

The binder resin according to the present invention may preferably be prepared through a process which basically includes preparation of a mixture of two or more polymers or copolymers.

In a preferred process, a low-molecular weight polymer or copolymer having little THF-insoluble content and being soluble in a polymerizable monomer is dissolved in such a polymerizable monomer or monomer mixture, followed by polymerization of the monomer or monomer mixture, to prepare a resin composition which may be a uniformly blended mixture of the former and the latter polymers or copolymers. The low-molecular weight polymer or copolymer may be prepared by polymerization, such as bulk polymerization, or solution polymerization.

More preferably, such a low-molecular weight polymer or copolymer containing an acid anhydride group is formed by solution polymerization, the polymer or copolymer is dissolved in a polymerizable monomer or monomer mixture to form a monomer composition, and the monomer composition is subjected to suspension polymerization in an aqueous medium. The low-molecular weight polymer or copolymer prepared by solution polymerization can be further subjected to polymerization together with a monomer or monomer mixture for providing a high-molecular weight polymer or copolymer. It is preferred to use emulsion polymerization or suspension polymerization also for providing a polymer or copolymer with a gel content which is sufficiently crosslinked as to provide a solvent-insoluble content.

The reactive metal compound to be used in the present invention may be those containing metal ions as follows: monovalent metal ions, such as $Na^+$, $Li^+$, $Cs^+$, $Ag^+$, $Hg^+$and $Cu^+$; divalent metal ions, such as $Ba^{2+}$, $Mg^{2+}$, $Ca^{2+}$, $Hg^{2+}$, $Sn^{2+}$, $Pb^{2+}$, $Fe^{2+}$, $Co^{2+}$, $Ni^{2+}$ and $Zn^{2+}$; and trivalent ions, such as $Al^{3+}$, $Sc^{3+}$, $Fe^{3+}$, $Ce^{3+}$, $Ni^{3+}$, $Cr^{3+}$and $Y^{3+}$. Among the compounds containing metal ions as described above, those which are readily decomposable provide good results. This is assumed to be because the metal ion in such a compound is thermally decomposed to be in a form readily bonded with a carboxyl group in the polymer or copolymer.

Among the reactive metal compounds, organic metal compounds provide excellent results because they are rich in compatibility with or dispersibility in a polymer and cause a crosslinking reaction uniformly in the polymer or copolymer.

Among the organic metal compounds, those containing an organic compound, which is rich in vaporizability or sublimability, as a ligand or a counter ion, are advantageously used. Among the organic compounds forming coordinate bonds or ion pairs with metal ions, examples of those having the above property may include: salicylic acid and its derivatives, such as salicylic acid, salicylamide, salicylamine, salicylaldehyde, salicylosalicylic acid, and di-tert-butylsalicylic acid; β-diketones, such as acetylacetone and propionylacetone; and low-molecular weight carboxylic acid salts, such as acetate and propionate.

In the toner of the present invention, a known charge control agent may be used according to the usage thereof, and it is also preferred that the above-mentioned metal complex also functions as a charge control agent.

For example, azo metal complexes represented by the following formula [I] also function as a negative charge control agent:

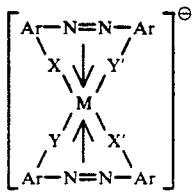

[I]

wherein M denotes a coordination center metal, inclusive of metal elements having a coordination number of 6, such as Cr, Co, Ni and Fe; Ar denotes an aryl group, such as phenyl or naphthyl, capable of having a substituent, examples of which may include: nitro, halogen, carboxyl, anilide, and alkyl and alkoxy having 1-18 carbon atoms; X, X', Y and Y' independently denote —O—, —CO—, —NH—, or —NR— (wherein R denotes an alkyl having 1-4 carbon atoms; and K⊕ denotes hydrogen, sodium, potassium, ammonium or aliphatic ammonium.

Specific examples of this type of complexes may include the following:

Complex [I]-1

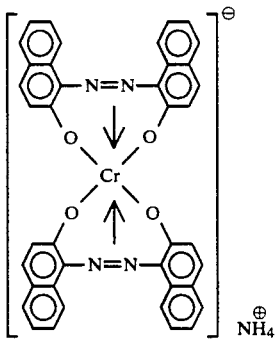

Complex [I]-2

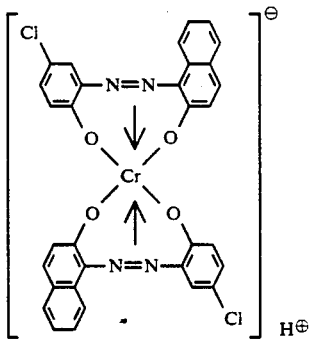

Complex [I]-3

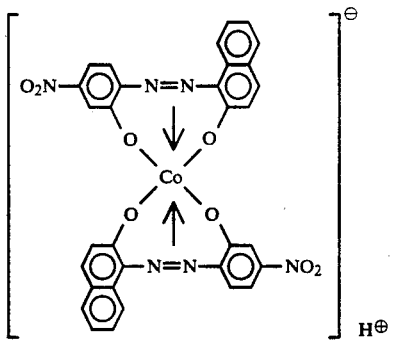

Complex [I]-4

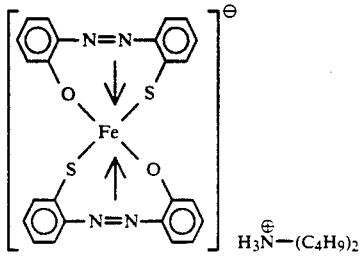

-continued

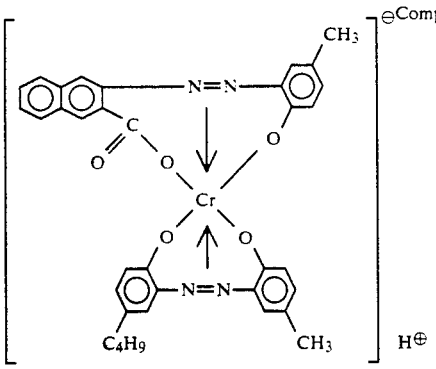

Complex [I]-5

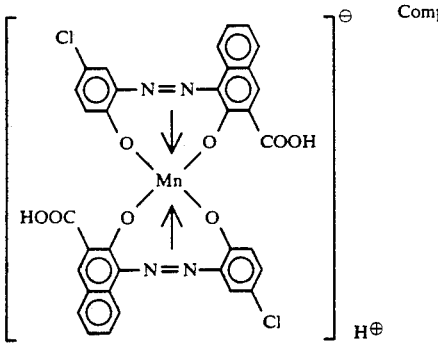

Complex [I]-6

Basic organic metal complexes represented by the following formula [II] impart a negative chargeability and may be used in the present invention.

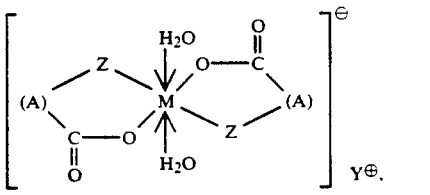

[II]

wherein M denotes a coordination center metal, inclusive of metal elements having a coordination number of 6, such as Cr, Co, Ni and Fe; A denotes

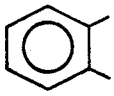

(capable of having a substituent,

-continued such as an alkyl).

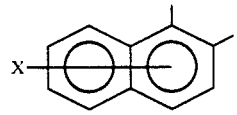

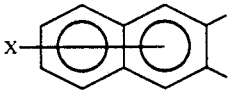

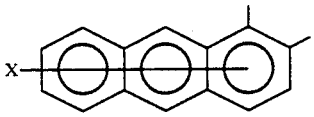

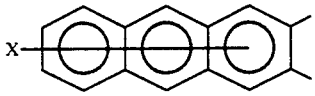

(X denotes hydrogen, halogen, or nitro),

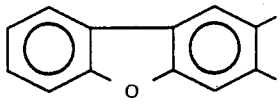

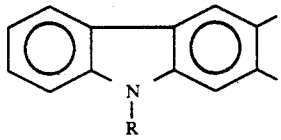

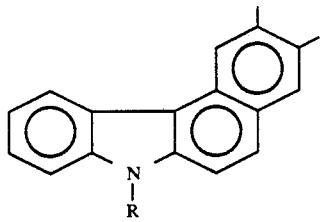

(R denotes hydrogen, $C_1$–$C_{18}$ alkyl or $C_1$–$C_{18}$ alkenyl); Y⊕ denotes a counter ion, such as hydrogen, sodium, potassium, ammonium, or aliphatic ammonium; and Z denotes —O— or —CO.O—.

Specific examples of this type of metal complexes may include the following:

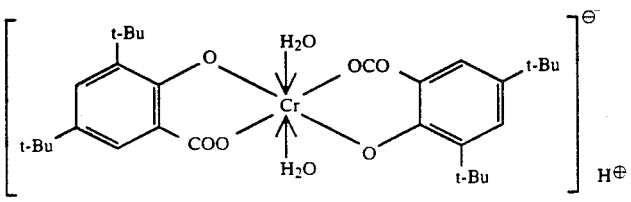

Complex [II]-1

-continued
Complex [II]-2
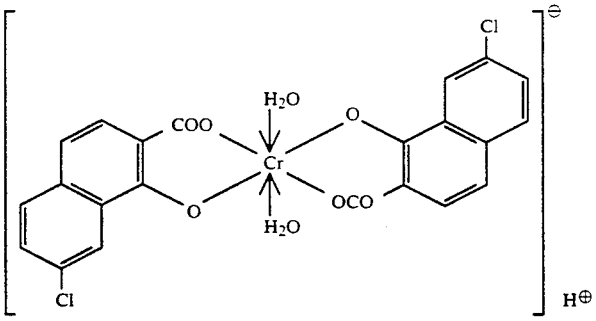
Complex [II]-3
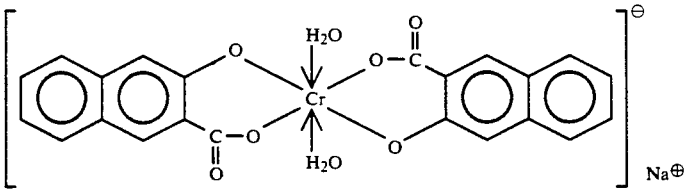
Complex [II]-4
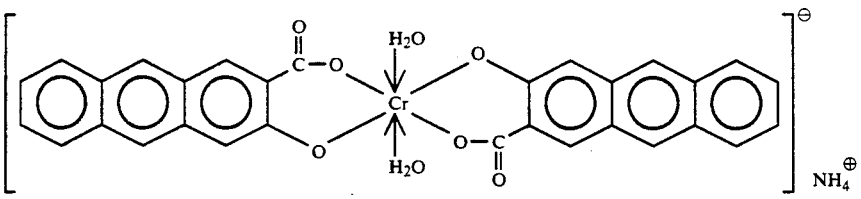
Complex [II]-5
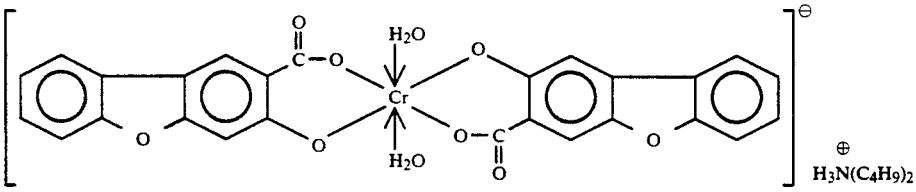
Complex [II]-6
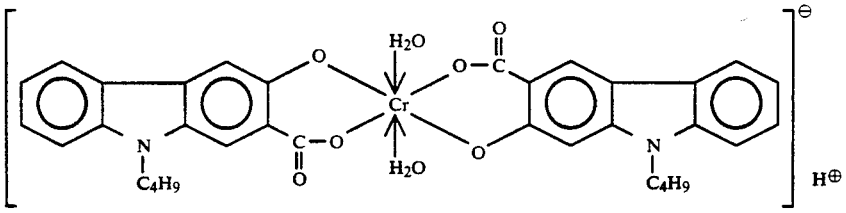
Complex [II]-7
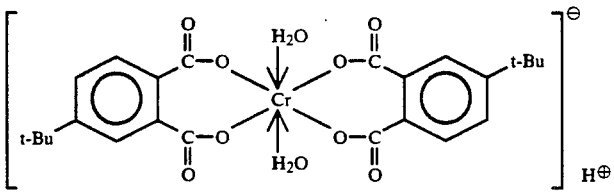
Complex [II]-8
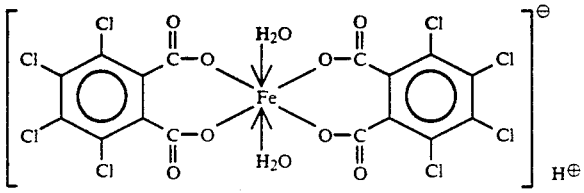

-continued

Complex [II]-9

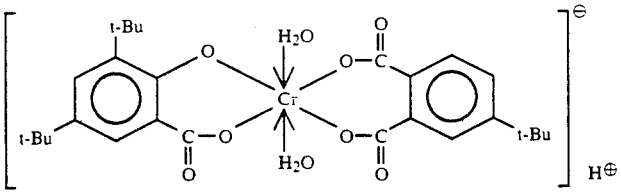

Complex [II]-10

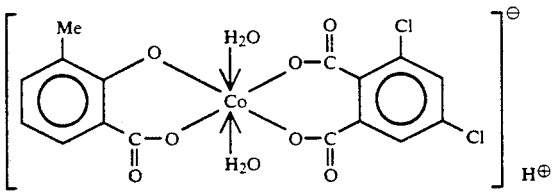

The above metal complexes may be used singly or in combination of two or more species.

The metal complex may be added to the toner in a proportion of 0.01–10 wt. parts, preferably 0.1–5 wt. parts, further preferably 1–5 wt. parts, per 100 wt. parts of the binder resin.

The above metal complex is rich in decomposability and reactivity particularly when it is reacted with the binder resin at the time of melt kneading than when it is added at the time of synthesis of the binder resin. Further, the metal complex is rich in compatibility or dispersibility in the binder and is advantageously used for providing the toner with a stable chargeability.

Additives (internal additives and external additives) may be added, as desired, to the toner according to the present invention. For example, a conventional dye and/or pigment may be used as a colorant. Ordinarily, a non-magnetic colorant may be used in a proportion of 0.5–20 wt. parts per 100 wt. parts of the binder resin. Other additives (external additives) may include: a lubricant, such as zinc stearate; an abrasive, such as cerium oxide or silicon carbide; a flowability-imparting agent or anti-caking agent, such as colloidal silica or aluminum oxide; and an electroconductivity-imparting agent.

It is also preferred to add 0.5–5 wt. % of waxy substance, such as low-molecular weight polyethylene, low-molecular weight polypropylene, microcrystalline wax, carnauba wax, sasol wax or paraffin wax, to the toner for the purpose of improving the releasability of the toner at the time of hot roller fixation.

The toner according to the present invention may be constituted as a magnetic toner containing a magnetic material in its particles. In this case, the magnetic material also functions as a colorant. Examples of the magnetic material may include: iron oxide, such as magnetite, hematite, and ferrite; metals, such as iron, cobalt and nickel, and alloys of these metals with other metals, such as aluminum, cobalt, copper, lead, magnesium, tin, zinc, antimony, beryllium, bismuth, cadmium, calcium, manganese, selenium, titanium, tungsten and vanadium; and mixtures of these materials.

The magnetic material may have an average particle size of 0.1–1 micron, preferably 0.1–0.3 micron, and may be contained in the toner in a proportion of 20–140 wt. parts, preferably 30–120 wt. parts, per 100 wt. parts of the resin component.

The toner according to the present invention may be prepared through a process including: sufficiently blending the binder resin, the metal salt or metal complex, a magnetic material, pigment or dye as the colorant, and an optional charge control agent and other additives, as desired, by means of a blender such as a ball mill, melting and kneading the blend by means of hot kneading means, such as hot rollers, a kneader or an extruder to cause mutual solution of the resinous materials and disperse or dissolve the magnetic material, pigment or dye therein, and cooling and solidifying the kneaded product, followed by pulverization and classification.

It is preferred to use the toner according to the present invention together with silica fine powder attached to the surface of toner particles in order to improve the charge stability, developing characteristic and fluidity.

The silica fine powder used in the present invention provides good results it it has a specific surface area of 30 $m^2/g$ or larger, preferably 50–400 $m^2/g$, as measured by nitrogen adsorption according to the BET method. The silica fine powder may be added in a proportion of 0.01–8 wt. parts, preferably 0.1–5 wt. parts, per 100 wt. parts of the toner.

For the purpose of being provided with hydrophobicity and/or controlled chargeability, the silica fine powder may well have been treated with a treating agent, such as silicone varnish, various modified silicone varnish, silicone oil, various modified silicone oil, silane coupling agent, silene coupling agent having functional group or other organic silicon compounds, or in combination with another treating agent.

In view of the developing performance, the toner according to the present invention may preferably be in the form of a magnetic toner, which comprises at least the binder resin, the magnetic material and the metal salt or metal complex, has a volume-average particle size of 4.5–8 microns, preferably 6–8 microns, and has such a particle size distribution that it contains 17–60% by number of magnetic toner particles of 5 microns or smaller, 5–50% by number of magnetic toner particles of 6.35–10.08 microns, and 2.0% by volume or less of magnetic toner particles of 12.7 microns or larger and satisfies the condition of $N/V=-0.5N+k$ . . . (1), wherein N is a number of 17–60 denoting the content in terms of % by number of the toner particles of 5 microns or smaller, V is a number denoting the content in terms of % by volume of the toner particles of 5 microns or smaller, and k is a number of 4.6–6.7.

When the volume-average particle size of the toner is below 4.5 microns, the toners coverage on a transfer paper is liable to be insufficient to provide a low image density, especially in the case of providing an image with a large proportion of image area, such as a graphic image. This is considered to be based on the same cause by which the central part of a latent image is developed into a lower density than the contour portion of the latent image. If the volume-average particle size is above 8 microns, the resolution of a digital latent image composed of minute spots of 100 microns or smaller becomes insufficient and the image quality is liable to be deteriorated during successive image formation.

If the content of the magnetic toner particles of 5 microns or smaller is below 17% by number, a portion of the magnetic toner particles effective for providing a high image quality is few and particularly, as the toner is consumed during a continuation of copying or printing-out, the effective component is preferentially consumed to result in an awkward particle size distribution of the magnetic toner and gradually deteriorates the image quality. If the content is above 60% by number, mutual agglomeration of the magnetic toner particles is liable to occur to produce toner lumps having a larger size than the proper size, thus leading to difficulties, such as rough image quality, a low resolution, a large difference in density between the contour and interior of an image to provide a somewhat hollow image.

It is preferred that the content of the particles in the range of 6.35–10.08 microns is 5–50% by number, further preferably 8–40% by number. Above 50% by number, the image quality becomes worse, and excess of toner coverage is liable to occur, thus resulting in an increased toner consumption. Below 5% by number, it becomes difficult to obtain a high image density in some cases.

Figure 10:
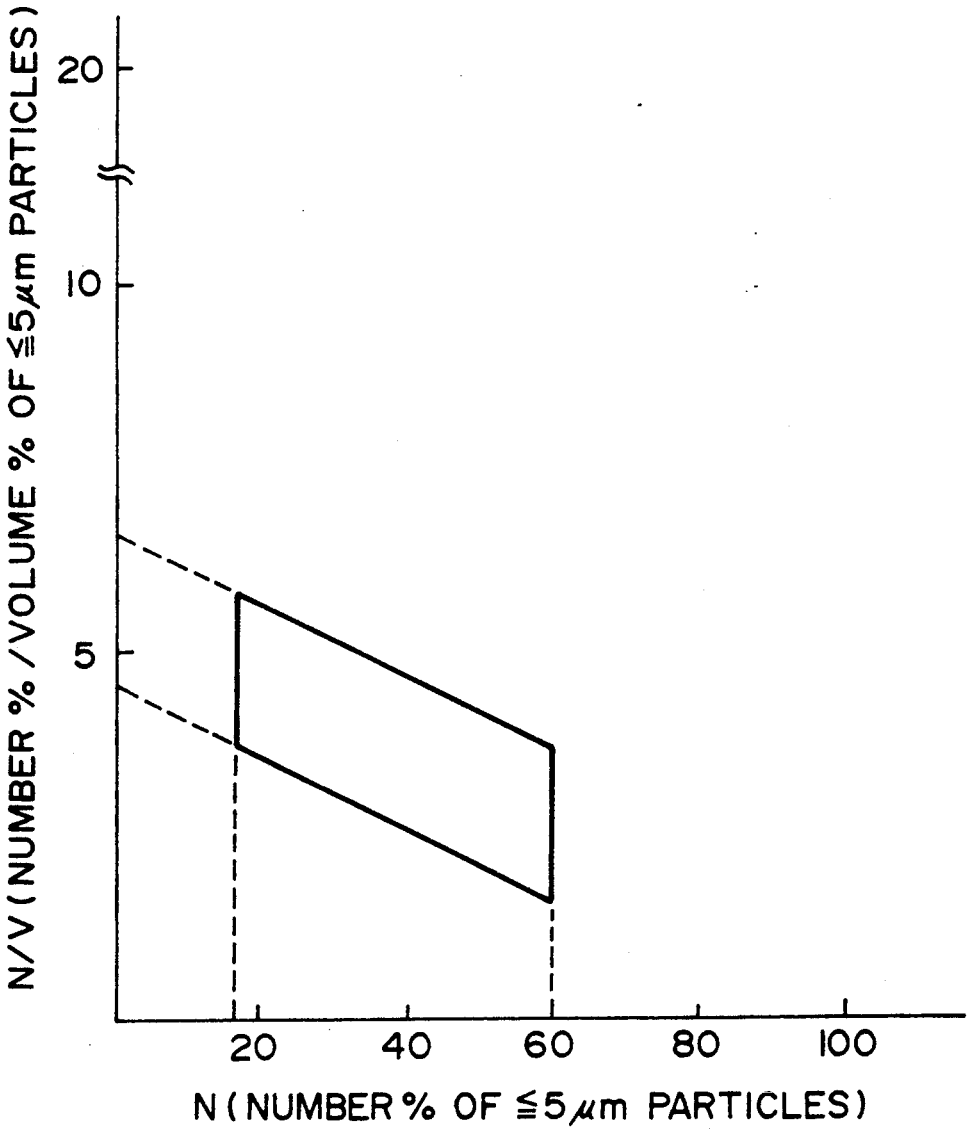
FIG. 10 is a graph showing the particle size distribution range for toner particles of 5 microns or smaller of a preferred class of toner according to the invention.

The contents of the magnetic toner particles of 5 microns or smaller in terms of % by number (N %) and % by volume (V %) may preferably satisfy the relationship of $N/V = -0.05N + k$, wherein k represents a positive number satisfying $4.6 \leqq k \leqq 6.7$, and N is a number satisfying $17 \leqq N \leqq 60$. The preferred range thus defined is shown in FIG. 10 as an area within a parallelogram. It is further preferred that $4.6 \leqq k \leqq 6.2$, particularly $4.6 \leqq k \leqq 5.7$ and $25 \leqq N \leqq 60$, particularly $30 \leqq N \leqq 60$.

(If $k < 4.6$, magnetic toner particles of 5.0 microns or below are insufficient, and the resultant image density, resolution and sharpness decrease. When fine toner particles in a magnetic toner, which have conventionally been considered useless, are present in an appropriate amount, they are effective for achieving closest packing of toner in development and contribute to the formation of a uniform image free of coarsening. Particularly, these particles fill thin-line portions and contour portions of an image, thereby to visually improve the sharpness thereof. If $k < 4.6$ in the above formula, such component becomes insufficient in the particle size distribution, and the above-mentioned characteristics become poor.

Further, in view of the production process, a large amount of fine powder must be removed by classification in order to satisfy the condition of $k < 4.6$. Such a process is however disadvantageous in yield and toner costs. On the other hand, if $k > 6.7$, an excess of fine powder is present, whereby the image density is liable to be decreased. This phenomenon is considered to be caused by attachment of excessive amount of fine magnetic toner particles with excessive charge onto the developing sleeve, so that carrying and triboelectrification of normal magnetic toner are hindered thereby.

In the magnetic toner of the present invention, the amount of magnetic toner particles having a particle size of 12.7 microns or larger is preferably 2.0% by volume or smaller, further preferably 1.0% by volume or smaller, more preferably 0.5% by volume or smaller. If the above amount is larger than 2.0% by volume, these particles are liable to impair thin-line reproducibility.

The particle size distribution of a toner is measured by means of a Coulter counter in the present invention, while it may be measured in various manners.

Coulter counter Model TA-II (available from Coulter Electronics Inc.) is used as an instrument for measurement, to which an interface (available from Nikkaki K.K.) for providing a number-basis distribution, and a volume-basis distribution and a personal computer CX-1 (available from Canon K.K.) are connected.

For measurement, a 1%-NaCl aqueous solution as an electrolytic solution is prepared by using a reagent-grade sodium chloride. For example, ISOTON®-II (available from Coulter Scientific Japan K.K.) may be used therefor. Into 100 to 150 ml of the electrolytic solution, 0.1 to 5 ml of a surfactant, preferably an alkylbenzenesulfonic acid salt, is added as a dispersant, and 2 to 20 mg of a sample is added thereto. The resultant dispersion of the sample in the electrolytic liquid is subjected to a dispersion treatment for about 1–3 minutes by means of an ultrasonic disperser, and then subjected to measurement of particle size distribution in the range of 2–40 microns by using the above-mentioned Coulter counter Model TA-II with a 100 micron-aperture to obtain a volume-basis distribution and a number-basis distribution. From the results of the volume-basis distribution and number-basis distribution, parameters characterizing the magnetic toner of the present invention may be obtained.

Figure 11:
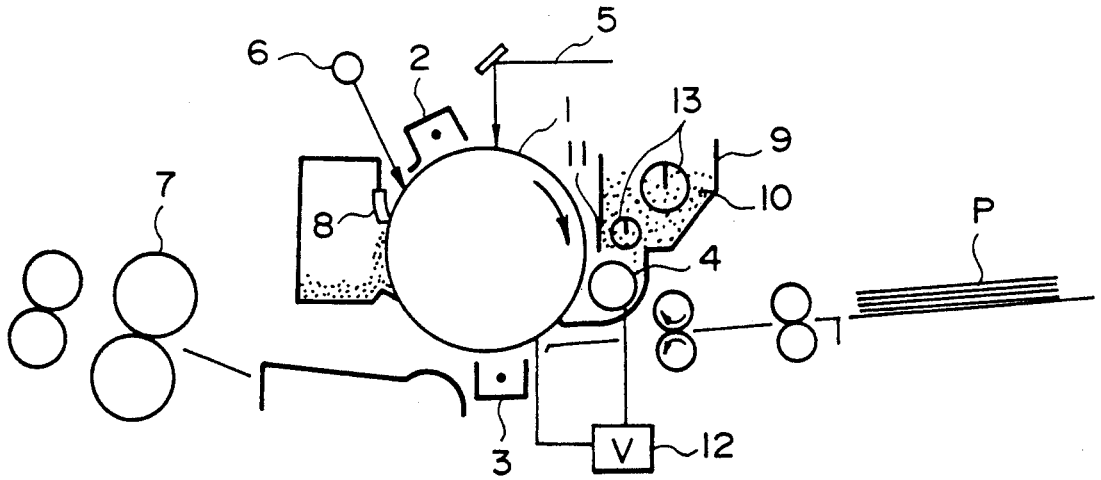
FIG. 11 is a schematic illustration of an embodiment of the image forming method and the image forming apparatus according to the present invention.

Now, the image forming method and the image forming apparatus according to the present invention will be specifically explained with reference to an embodiment shown in FIG. 11.

A photosensitive member (drum) 1 surface is charged, e.g., in a negative polarity by a primary charger 2, then exposed with image light 5 (e.g., laser light) to form a latent image (e.g., a digital latent image formed by image scanning), and the latent image is developed (e.g., reversely developed) with a monocomponent-type magnetic developer 10 comprising a magnetic toner contained in a developing device 9 equipped with a magnetic blade 11 and a developing sleeve 4 containing therein a magnet. At the developing station or zone, an alternating bias, a pulsed bias and/or a DC bias is applied between the photosensitive drum 1 and the developing sleeve 4 by a bias application means 12. A sheet of transfer paper P is conveyed to reach a transfer station, where the back side (opposite side with respect to the photosensitive drum) of the transfer paper is charged by a transfer means 3, whereby a developed image (toner image) on the photosensitive drum surface is electrostatically transferred. The transfer paper P separated from the photosensitive drum 1 is sent to a hot pressure roller fixer where the toner image on the transfer paper P is fixed.

Some magnetic toner remaining on the photosensitive drum 1 after the transfer step is removed by a cleaning device 8 equipped with a cleaning blade. The photosensitive drum 1 is discharged by an erasing exposure light source 6 and is subjected to a repeating cycle starting with the charging step by the primary charger 2.

The photosensitive drum (electrostatic image-bearing member) comprises a photosensitive layer on an electroconductive substrate and rotates in the direction of the arrow. The developing sleeve 4 as a toner-carrying member comprising a non-magnetic cylinder rotates so as to move in the same direction as the electrostatic image-bearing member surface at the developing station. Inside the non-magnetic cylindrical sleeve 4 is disposed a multi-polar permanent magnet (magnet roll) so as not to rotate. The magnetic toner 10 in the developing device 9 is applied onto the non-magnetic cylinder 4 surface and the toner particles are provided with, e.g., a negative charge due to friction, e.g., between the developing sleeve 4 surface and the toner particles. The magnetic doctor blade 11 of iron is disposed in proximity with the cylindrical developing sleeve surface with a gap of about 50 microns to 500 microns and so as to confront one magnetic pole of the multi-polar permanent magnet, whereby a magnetic toner layer is formed in a thin and uniform thickness (30–300 microns) so that the magnetic toner layer is thinner than the gap between the electrostatic image-bearing member 1 and the developing sleeve 4 at the developing station. The revolution speed of the developing sleeve 4 is adjusted so that the sleeve surface velocity is substantially the same as or close to the speed of the electrostatic image-carrying surface. It is possible to compose the magnetic doctor blade 11 of a permanent magnet instead of iron. At the developing station, it is possible to apply an AC bias or a pulsed bias between the developing sleeve 4 and the electrostatic image-bearing member 1 surface by the biasing means 12. The AC bias may appropriately comprise a frequency f of 200–4,000 Hz and a peak-to-peak voltage Vpp of 500–3,000 V.

At the developing station, the toner particles are transferred to the electrostatic image side because of an electrostatic force exerted by the electrostatic image-bearing member surface and the action of the AC bias or pulsed bias electric field.

Instead of the magnetic doctor blade 11, an elastic blade formed of an elastic material such as silicone rubber can also be used to apply the toner in a regulated thickness onto the developing sleeve under the action of a pressing force.

Figure 12:
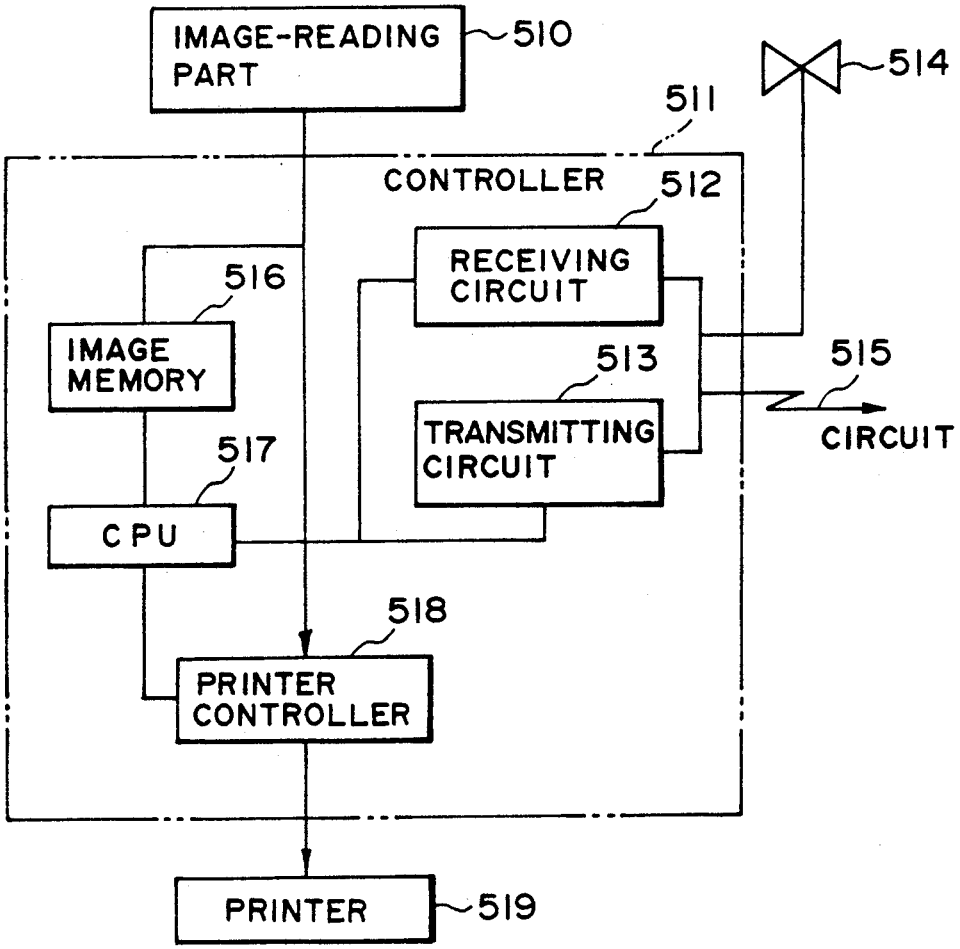
FIG. 12 is a block diagram showing a system constituting a facsimile apparatus using an image forming apparatus as a printer thereof.

In a case where the image forming apparatus according to the present invention is used as a printer for facsimile, the laser light 5 may be replaced by exposure light image for printing received data. FIG. 12 is a block diagram for illustrating such an embodiment.

Referring to FIG. 12, a controller 511 controls an image reader (or image reading unit) 510 and a printer 519. The entirety of the controller 511 is regulated by a CPU 517. Data read from the image reader 510 is transmitted through a transmitter circuit 513 to a remote terminal such as another facsimile machine. On the other hand, data received from a remote terminal is transmitted through a receiver circuit 512 to a printer 519. An image memory 516 stores prescribed image data. A printer controller 518 controls the printer 519. A telephone handset 514 is connected to the receiver circuit 512 and the transmitter circuit 513.

More specifically, an image received from a line (or circuit) 515 (i.e., image data received a remote terminal connected by the line) is demodulated by means of the receiver circuit 512, decoded by the CPU 517, and sequentially stored in the image memory 516. When image data corresponding to at least one page is stored in the image memory 516, image recording or output is effected with respect to the corresponding page. The CPU 517 reads image data corresponding to one page from the image memory 516, and transmits the decoded data corresponding to one page to the printer controller 518. When the printer controller 518 receives the image data corresponding to one page from the CPU 517, the printer controller 518 controls the printer 519 so that image data recording corresponding to the page is effected. During the recording by the printer 519, the CPU 517 receives another image data corresponding to the next page.

Thus, receiving and recording of an image may be effected in the above-described manner.

In the electrophotographic apparatus, plural members inclusive of some of the above-mentioned members such as electrostatic image-bearing member or the photosensitive member, developing apparatus and cleaning means can be integrally combined to form an apparatus unit so that the unit can be connected to or released from the apparatus body. For example, at least one of the charging means, developing apparatus and cleaning means can be integrally combined with the photosensitive member to form a single unit so that it can be freely attached to or released from the apparatus body by means of a guide means such as a guide rail provided to the body.

Hereinbelow, the present invention will be explained more specifically based on Examples.

SYNTHESIS EXAMPLE 1

200 wt. parts of cumene was charged in a reaction vessel and heated to the reflux temperature. The following mixture was added thereto in 4 hours under refluxing of cumene.

| | |
|---|---|
| Styrene | 74 wt. parts |
| n-Butyl acrylate | 16 wt. parts |
| Monobutyl maleate | 10 wt. parts |
| Di-tert-butyl peroxide | 6 wt. parts |

The polymerization was further continued and completed under reflux of cumene (146–156° C.), followed by removal of cumene. The thus obtained non-crosslinked styrene copolymer showed a main peak at a molecular weight of 5,000 and a glass transition temperature (Tg) of 60° C. The thus obtained non-crosslinked styrene copolymer in an amount of 30 wt. parts was dissolved in the following monomer mixture to form a polymerizable mixture.

| | |
|---|---|
| Styrene | 48 wt. parts |
| n-Butyl acrylate | 20 wt. parts |
| Monobutyl maleate | 2 wt. parts |
| Divinylbenzene | 0.4 wt. part |
| Benzoyl peroxide | 1.7 wt. parts |

170 wt. parts of water containing 0.1 wt. part of partially saponified polyvinyl alcohol was added to the above polymerizable mixture to form a suspension liquid. Into a reaction vessel containing 15 wt. parts of water and aerated with nitrogen. The above suspension liquid was added and subjected to 6 hours of suspension polymerization at 70–95° C. After the reaction, the product was separated by filtration, dewatered and dried to obtain a resin composition containing a styrene-n-butyl acrylate-monobutyl maleate copolymer and also a styrene-n-butyl acrylate-maleic acid-maleic anhydride copolymer. The resultant resin composition showed a THF-insoluble content of 40 wt. %, a Tg of 59° C., a JIS acid value (A) of 18.4 and a ratio (A/B) of 0.90 to the total acid value (B), and contained a THF-soluble content giving a GPC chart showing a peak at a molecular weight of about 5500 and a shoulder at a molecular weight of about $3.4\times10^4$.

The THF-soluble content of the resin composition was measured as follows:

About 0.5 g of the resin composition was accurately weighed ($W_1$ g) and placed in a cylindrical filter paper (28×100 mm, "No. 86R", available from Toyo Roshi K.K.) and then subjected to extraction with 200 ml of solvent THF for 6 hours by using a Soxhlet's extractor. Each extraction cycle with THF by the Soxhlet's extractor took about 4 minutes The THF-soluble content extracted with THF was recovered by evaporation of the THF, dried under vacuum at 100° C. and then weighed ($W_2$ g). The calculation was made according to the following equation:

$$\textit{THF insoluble content}\ (\%)=[W_1-W_2]/W_1\times100.$$

The glass transition point (Tg) of the resin was measured according to ASTM D 341-82 by using a DSC (differential scanning calorimeter, "DSC-7" available from Perkin-Elmer Corp.)

SYNTHESIS EXAMPLE 2

| | |
|---|---|
| Styrene | 80 wt. parts |
| n-Butyl acrylate | 15 wt. parts |
| Acrylic acid | 5 wt. parts |
| Di-tert-butyl peroxide | 7 wt. parts |

The above ingredients were added dropwise in 4 hours to 200 wt. parts of cumene which had been heated to the reflux temperature. The solution polymerization was further completed under reflux of cumene (146–156° C.), followed by removal of cumene. The resultant styrene copolymer showed a peak at a molecular weight of 5200 on the GPC chart and a Tg of 62° C.

30 wt. parts of the styrene copolymer was dissolved in the following monomer mixture to form a mixture solution.

| | |
|---|---|
| Styrene | 47 wt. parts |
| n-Butyl acrylate | 23 wt. parts |
| Monobutyl maleate | 1 wt. parts |
| Divinylbenzene | 0.6 wt. part |
| Benzoyl peroxide | 1.5 wt. part |

170 wt. parts of water containing 0.1 wt. part of partially saponified polyvinyl alcohol was added to the above mixture solution to form a suspension liquid. Into a reaction vessel containing 15 wt. parts of water and aerated with nitrogen, the above suspension liquid was added and subjected to 6 hours of suspension polymerization at 10–95° C. After the reaction, the product was separated by filtration, dewatered and dried to obtain a resin composition containing a crosslinked styrene-n-butyl acrylate-monobutyl maleate copolymer. The thus-obtained resin composition contained 55 wt. % of a THF-insoluble content, showed a Tg of 54° C., a JIS acid value (A) of 13.0 and a ratio (A/B) of 0.97 to the total acid value (B), and the THF-soluble content gave a GPC chart showing a peak at a molecular weight of about 6000 and a shoulder at a molecular weight of about $3.2\times10^4$.

SYNTHESIS EXAMPLE 3

| | |
|---|---|
| Styrene | 76 wt. parts |
| n-Butyl acrylate | 14 wt. parts |
| Monobutyl maleate | 15 wt. parts |
| Di-tert-butyl peroxide | 4 wt. parts |

The above ingredients were added dropwise in 4 hours to 200 wt. parts of xylene which had been heated to the reflux temperature. The solution polymerization was further completed under reflux of xylene (138–144° C.), followed by removal of xylene. The resultant non-crosslinked styrene copolymer showed a peak at a molecular weight of 5500 on the GPC chart and a Tg of 63° C.

20 wt. parts of the styrene copolymer was dissolved in the following monomer mixture to form a mixture solution.

| | |
|---|---|
| Styrene | 36 wt. parts |
| n-Butyl acrylate | 24 wt. parts |
| Monobutyl maleate | 3 wt. parts |
| Divinylbenzene | 0.35 wt. part |
| Benzoyl peroxide | 1.3 wt. parts |

170 wt. parts of water containing 0.1 wt. part of partially saponified polyvinyl alcohol was added to the above mixture solution to form a suspension liquid. Into a reaction vessel containing 15 wt. parts of water and aerated with nitrogen, the above suspension liquid was added and subjected to 6 hours of suspension polymerization at 70–95° C. After the reaction, the product was separated by filtration, dewatered and dried to obtain a resin composition containing a crosslinked styrene-n-butyl acrylate-monobutyl maleate copolymer. The thus-obtained resin composition contained 30 wt. % of a THF-insoluble content, showed a Tg of 57° C., a JIS acid value (A) of 30.5 and a ratio (A/B) of 0.81 to the total acid value (B), and the THF-soluble content gave a GPC chart showing peaks at molecular weights of about 6000 and about $3.6\times10^4$.

COMPARATIVE SYNTHESIS EXAMPLE 1

| | |
|---|---|
| Styrene | 100 wt. parts |
| Di-tert-butyl peroxide | 10 wt. parts |

The above ingredients were added dropwise in 4 hours to 200 wt. parts of cumene which had been heated to the reflux temperature. The solution polymerization was further completed under reflux of cumene (146–156° C.), followed by removal of cumene. The resultant styrene copolymer showed a peak at a molecular weight of 4000 on the GPC chart and a Tg of 67° C.

30 wt. parts of the styrene copolymer was dissolved in the following monomer mixture to form a mixture solution.

| | |
|---|---|
| Styrene | 60 wt. parts |
| n-Butyl acrylate | 20 wt. parts |
| Benzoyl peroxide | 2 wt. parts |

170 wt. parts of water containing 0.1 wt. part of partially saponified polyvinyl alcohol was added to the above mixture solution to form a suspension liquid. Into a reaction vessel containing 15 wt. parts of water and aerated with nitrogen, the above suspension liquid was added and subjected to 6 hours of suspension polymerization at 70–95° C. After the reaction, the product was separated by filtration, dewatered and dried to obtain a resin composition containing a polystyrene and a non-crosslinked styrene-n-butyl acrylate copolymer. The thus-obtained resin composition was soluble in THF, gave a GPC chart showing peaks at molecular weights of about 4500 and about $3.0\times10^4$, and showed a JIS acid value (A) of 0.6.

COMPARATIVE SYNTHESIS EXAMPLE 2

170 wt. parts of water containing 0.1 wt. part of partially saponified polyvinyl alcohol was added to the following monomer mixture to form a suspension liquid.

| | |
|---|---|
| Styrene | 69 wt. parts |
| n-Butyl acrylate | 25 wt. parts |
| Monobutyl maleate | 6 wt. parts |
| Divinylbenzene | 0.9 wt. part |
| Benzoyl peroxide | 3 wt. part |

Into a reaction vessel containing 15 wt. parts of water and aerated with nitrogen, the above suspension liquid was added and subjected to 6 hours of suspension polymerization at 70–95° C. After the reaction, the product was separated by filtration, dewatered and dried to obtain a crosslinked styrene-n-butyl acrylate-monobutyl maleate copolymer. The thus-obtained copolymer gave a GPC chart showing a main peak at a molecular weight of about 17,000 and substantially no peak below a molecular weight of 15,000.

The copolymer also showed a Tg of 60° C., a JIS acid value (A) of 16.6, a ratio (A/B) of about 1 to the total acid value (B), and a THF-insoluble content of 30 wt. %.

COMPARATIVE SYNTHESIS EXAMPLE 3

200 wt. parts of cumene was charged in a reaction vessel and heated to the reflux temperature. The following mixture was added thereto in 4 hours.

| | |
|---|---|
| Styrene | 72 wt. parts |
| n-Butyl Acrylate | 25 wt. parts |
| Monobutyl maleate | 3 wt. parts |
| Divinylbenzene | 1.0 wt. part |
| Di-tert-butyl peroxide | 1.0 wt. parts |

The solution polymerization was further continued for 4 hours under reflux of cumene, followed by removal of the solvent by ordinary distillation under vacuum to obtain a copolymer.

The copolymer showed a THF-insoluble content of 5 wt. %, peaks at molecular weights of about 17,000 and about $80\times10^4$ on the GPC chart, a Tg of 60° C., a JIS acid value (A) of 8.6 and a ratio (A/B) of 0.66 to the total acid value (B).

EXAMPLE 1

| | |
|---|---|
| Resin of Synthesis Example 1 | 100 wt. parts |
| Magnetic material | 70 wt. parts |
| (number-average particle size = 0.19 micron) | |
| Complex [I]-2 | 1 wt. part |
| Low-molecular weight ethylene-propylene copolymer | 3 wt. parts |

The above ingredients were sufficiently blended in a blender and melt-kneaded through a two-axis kneading extruder set at 130° C. The resultant kneaded product showed a lower melt index than corresponding kneaded product which was prepared under the same condition except that the complex [I]-2 was not added.

The kneaded product was cooled, coarsely crushed by a cutter mill, finely pulverized by means of a pulverizer using jet air stream, and classified by a fixed-wall type wind-force classifier to obtain a classified powder product. Ultra fine powder and coarse powder were simultaneously and precisely removed from the classified powder by means of a multi-division classifier utilizing a Coanda effect (Elbow Jet Classifier available from Nittetsu Kogyo K.K.), thereby to obtain a magnetic toner having a volume-average particle size of 10 microns.

100 wt. parts of the above toner and 0.6 wt. part of hydrophobic colloidal silica fine powder treated with silicone oil were dry-blended with each other to prepare a magnetic toner comprising magnetic toner particles onto the surface of which the hydrophic colloidal silica fine powder was attached.

Figure 2:
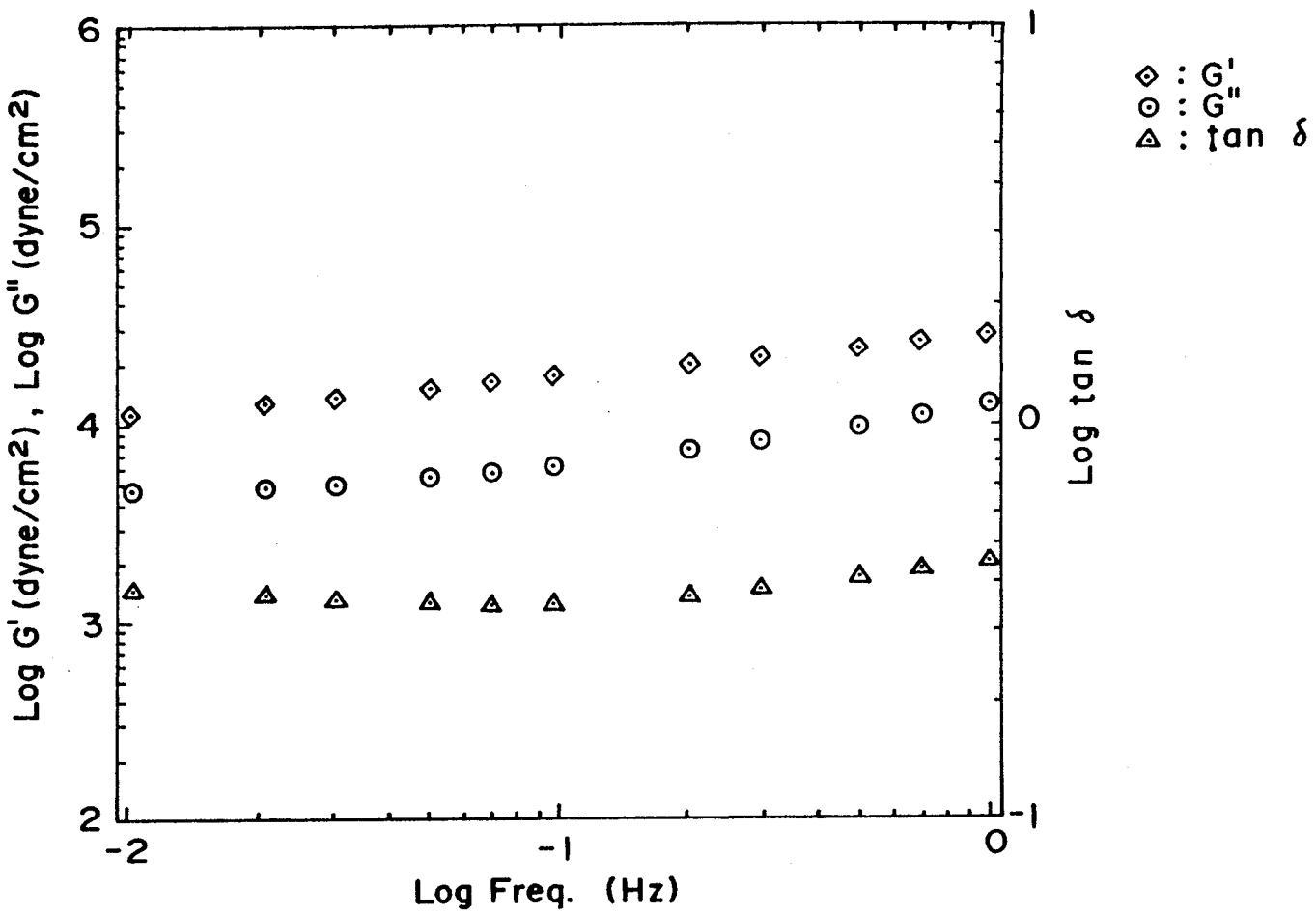
FIG. 2 is a graph showing the frequency-dependence (0.01 Hz–1 Hz) of the viscoelasticity at 200° C. of the toner according to Example 1.
Figure 3:
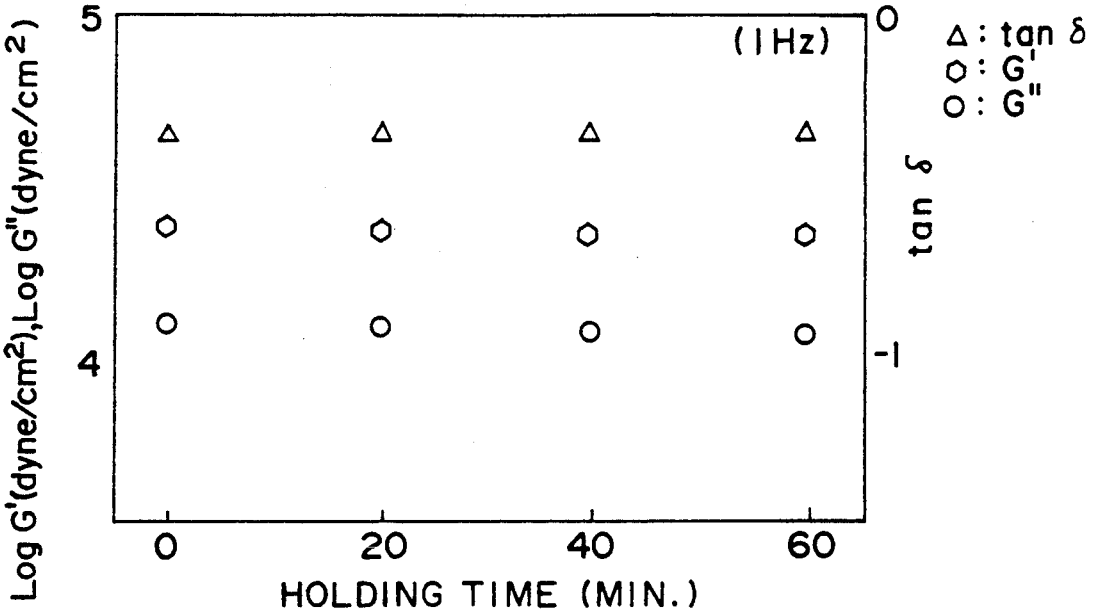
FIGS. 3 and 4 are graphs showing changes with time in viscoelasticity at 200° C., and 0.1 Hz and 1 Hz, respectively, of the toner according to Example 1.
Figure 4:
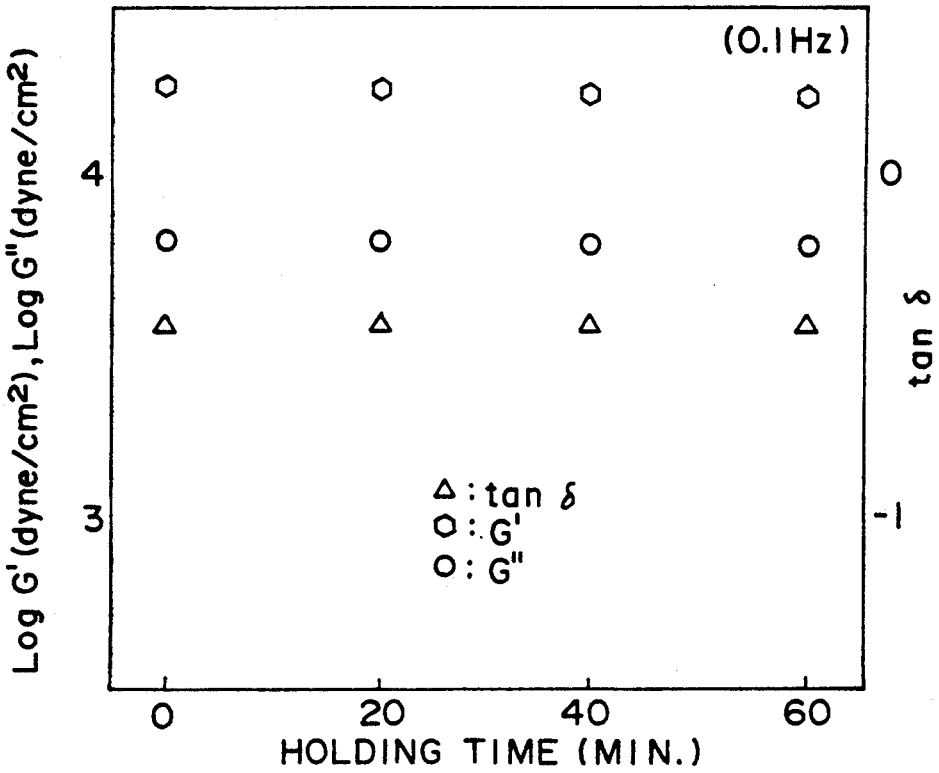

The viscoelastic properties of the magnetic toner were measured at 120° C. and 200° C., and the results thereof are shown in FIGS. 1 and 2, respectively. As shown in these figures, the dynamic modulus G' and loss modulus G'' were within the range of $2\times10^3$–$5\times10^5$ dyne/cm$^2$ from 120° C. to 200° C., and the ratio $G'_{120}/G'_{200}$ was below 40. Further, the viscoelastic properties were not substantially changed with time at 200° C. as shown in FIGS. 3 and 4. The viscoelastic data of the toner are also shown in Table 1 appearing hereinafter together with those of other Examples.

The magnetic toner was evaluated for image formation by using a printer prepared by remodeling a commercially available small-size laser beam printer ("LBP-8II", made by Canon K.K.) so as to provide a printing speed of 16 sheets (A4-vertical)/min. The evaluation was performed with respect to the initial image quality and fixability, and anti-offset characteristic and staining of hot fixing rollers after 5000 sheets of printing. The developing conditions were as follows:

| | |
|---|---|
| The closest gap between the laminated OPC photosensitive drum and the developing sleeve (enclosing a fixed magnet): | about 300 microns |
| The gap between the magnetic blade and the developing sleeve: | about 250 microns |
| The magnetic toner layer thickness on the coated developing sleeve: | about 130 microns |
| Developing bias: AC bias (Vpp: 1600 V, frequency: 1800 Hg), DC bias: | −390 V. |

The fixability evaluation was performed as follows. The test apparatus was placed in an environment of normal temperature and normal humidity (temperature: 23° C., humidity: 60%). After the apparatus and the fixing device therein were fully adapted to the environment, a power was supplied. Immediately after the waiting time was up, a pattern of 200 micron-wide transverse lines (line width: 200 microns, spacing: 200 microns) was printed on a first sheet, which was used for evaluation of the fixability. The fixing was effected by setting the surface temperature of a fluorine resin-coated hot fixing roller at 180° C. The fixability was evaluated by rubbing the printed image with a lens cleaning paper ("Dusper" ®, made by OZU Paper Co. Ltd.) for 5 reciprocations under a weight of 100 g and then evaluating the degree of peeling of the toner image in terms of a decrease (%) in reflection density.

For the evaluation of the anti-offset characteristic, a 100 microns-wide transverse line pattern was continuously printed on 300 sheets by using a fresh fixing roller cleaning pad, then the printing was paused for 30 seconds and then the printing was resumed. Then, the back-staining on a first sheet after the resumption was observed for the evaluation.

For the evaluation of the hot fixing roller staining, a character pattern with a dot ratio of 4% was printed continuously on 5000 sheets (A4-vertical) by using a fresh fixing roller cleaning pad and thereafter the staining on the surface of the hot fixing roller was observed with eyes.

After the above observation, the 100 microns-wide transverse line pattern was continuously printed on 300 sheets (A4-vertical), then the printing was paused for 30 seconds and then the printing was resumed. Then, the back standing on a first sheet after the resumption was again observed for evaluation of the anti-offset characteristic.

For the above evaluation, bond paper having a surface smoothness of 10 [sec] or below was used as the transfer paper.

The evaluation standards are shown below.

(1) Fixability

○: Good

Δ: Somewhat inferior but practically acceptable

×: Practically not acceptable (2) Hot fixing roller staining in the fixing device ○: No stain at all ○Δ: Slight stain which is almost unnoticeable Δ: Noticeable stain but practically acceptable (no offsetting)

×: Conspicuous stain and practically not acceptable (offsetting)

(3) Anti-offset characteristic (back stain after pause)

○: No stain at all

○Δ: Almost unnoticeable

Δ: Stain but practically acceptable

×: Conspicuous stain and practically unacceptable

The evaluation results are summarized in Table 2 appearing hereinafter.

EXAMPLE 2-4, COMPARATIVE EXAMPLES 1-3

Toners were prepared in the same manner as in Example 1 except that the resins and metal complexes were formulated (selected and mixed) as shown in Table 1. The viscoelastic data of the toners are also shown in Table 1 and the results of evaluation are shown in Table 2.

TABLE 1

| | Formulation | | Viscoelastic data | | | | | | |
|---|---|---|---|---|---|---|---|---|---|
| | Binder resin | Organic metal complex | $G'_{120Max}$* | $G'_{200Min}$* | a | $G'_{200}/G'_{120}$ at 1 Hz | $G''_{120Max}$* | $G''_{200Min}$* | Change with time |
| Ex. 1 | Syn. Ex. 1 100 parts | [I]-2 1 part | $4.0 \times 10^5$ | $1.2 \times 10^4$ | 0.17 | 0.07 | $3.2 \times 10^5$ | $4.5 \times 10^3$ | Almost No |
| Ex. 2 | Syn. Ex. 2 100 parts | [II]-1 1 part | $1.2 \times 10^5$ | $1.3 \times 10^4$ | 0.22 | 0.23 | $1.0 \times 10^5$ | $9.0 \times 10^3$ | " |
| Ex. 3 | Syn. Ex. 3 100 parts | [I]-2 1 part | $4.5 \times 10^5$ | $1.5 \times 10^4$ | 0.14 | 0.16 | $3.5 \times 10^5$ | $1.2 \times 10^4$ | " |
| Ex. 4 | Syn. Ex. 1 100 parts | [I]-2 0.5 part [II]-1 0.5 part | $2.0 \times 10^5$ | $4.1 \times 10^4$ | 0.14 | 0.20 | $1.8 \times 10^5$ | $3.4 \times 10^4$ | " |
| Comp. Ex. 1 | Comp. Syn. Ex. 1 100 parts | [I]-2 1 part | $1.9 \times 10^5$ | $3.1 \times 10^2$ | 0.35 | 0.01 | $1.8 \times 10^5$ | $2.0 \times 10^2$ | " |
| Comp. Ex. 2 | Comp. Syn. Ex. 2 100 parts | [I]-2 1 part | $1.8 \times 10^5$ | $1.0 \times 10^3$ | 0.32 | 0.24 | $1.5 \times 10^5$ | $9.5 \times 10^2$ | " |
| Comp. Ex. 3 | Comp. Syn. Ex. 3 100 parts | [I]-2 1 part | $2.1 \times 10^5$ | $5.8 \times 10^2$ | 0.37 | 0.22 | $1.0 \times 10^5$ | $5.1 \times 10^2$ | Yes |

*$G'_{120Max}$, $G'_{200Min}$, $G''_{120Max}$, $G''_{200Min}$: Respectively, the maximum or minimum data in the frequency range of $10^{-2}$ – 1 Hz.

TABLE 2

| | Fixability | Anti-offset | Pulverizability* | Hot fixing roller stain (after 5000 sheets) |
|---|---|---|---|---|
| Example 1 | ○ | ○ | ○ | ○ |
| 2 | ○ | ○ | ○ | ○ |
| 3 | ○ | ○ | ○ | ○ |
| 4 | ○ | ○ | ○ | ○ |
| Comp. Example 1 | Δ | x | ○ | x |
| 2 | x | Δ | x | Δ |
| 3 | x | Δ | x | ○Δ |

*Pulverizability of kneaded product

EXAMPLE 5

| | |
|---|---|
| Resin of Synthesis Example 1 | 100 wt. parts |
| Magnetic material | 100 wt. parts |
| Complex [I]-2 | 0.5 wt. part |
| Low-molecular weight ethylene-propylene copolymer | 3 wt. part |

The above ingredients were sufficiently blended in a blender and melt-kneaded through a two-axis kneading extruder set at 130° C. The kneaded product was cooled, coarsely crushed by a cutter mill, finely pulverized by means of a pulverizer using jet air stream, and classified by a fixed-wall type wind-force classifier to obtain a classified powder product. Ultra fine powder and coarse powder were simultaneously and precisely removed from the classified powder by means of a multi-division classifier utilizing a Coanda effect (Elbow Jet Classifier available from Nittetsu Kogyo K.K.), thereby to obtain a magnetic toner having a volume-average particle size of 6.5 microns.

The thus obtained magnetic toner was subjected to measurement of particle size distribution by means of a Coulter counter Model TA-II equipped with a 100 microns-aperture and the measured data are shown in Table 3 appearing hereinafter.

100 wt. parts of the above toner and 1.0 wt. part of hydrophobic colloidal silica fine powder were dry-blended with each other to prepare a magnetic toner comprising magnetic toner particles onto the surface of which the hydrophic colloidal silica fine powder was attached.

Figure 5:
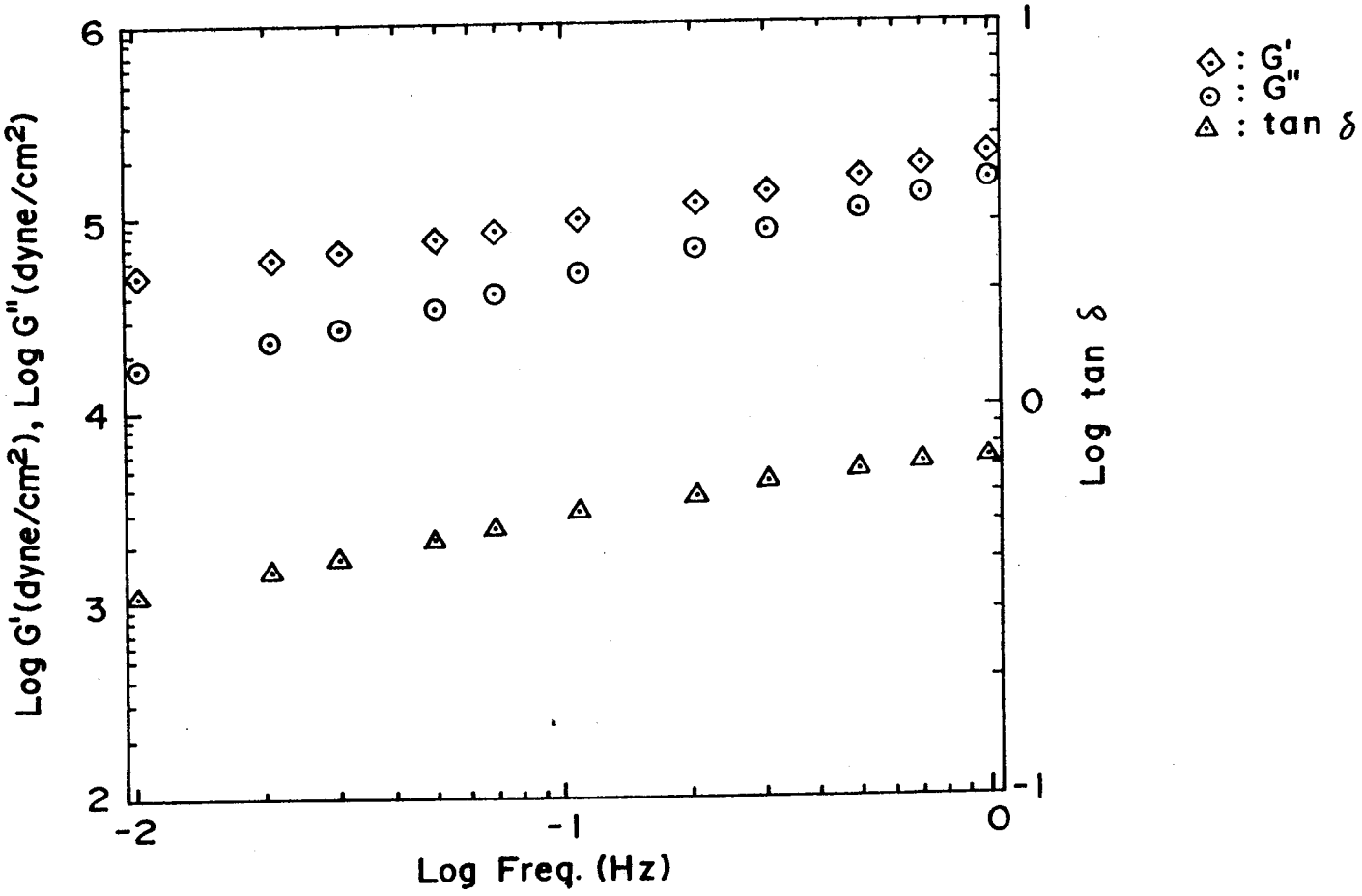
FIG. 5 is a graph showing the frequency-dependence (0.01 Hz–1 Hz) of the viscoelasticity at 120° C. of the toner according to Example 5.
Figure 6:
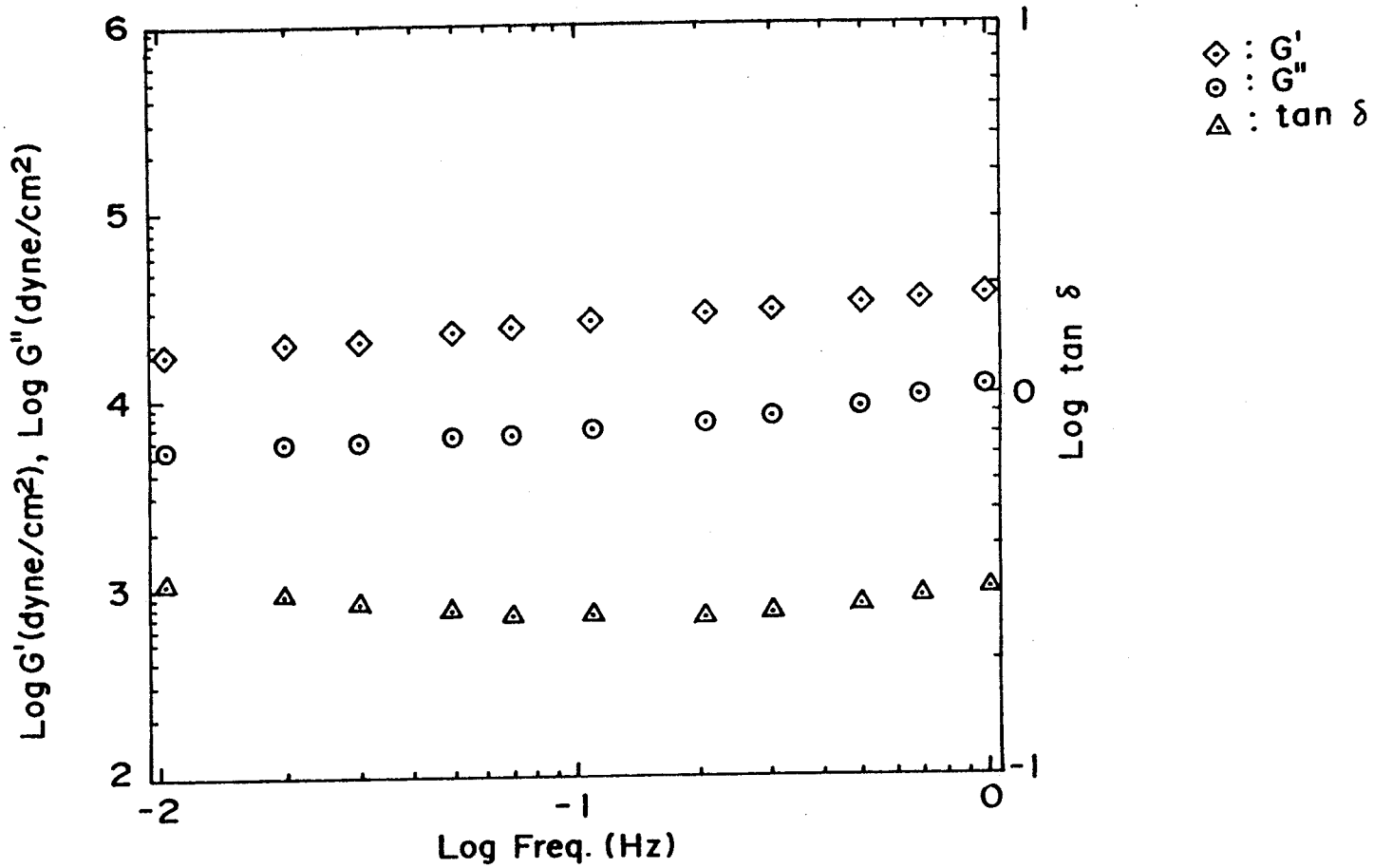
FIG. 6 is a graph showing the frequency-dependence (0.01 Hz–1 Hz) of the viscoelasticity at 200° C. of the toner according to Example 5.
Figure 7:
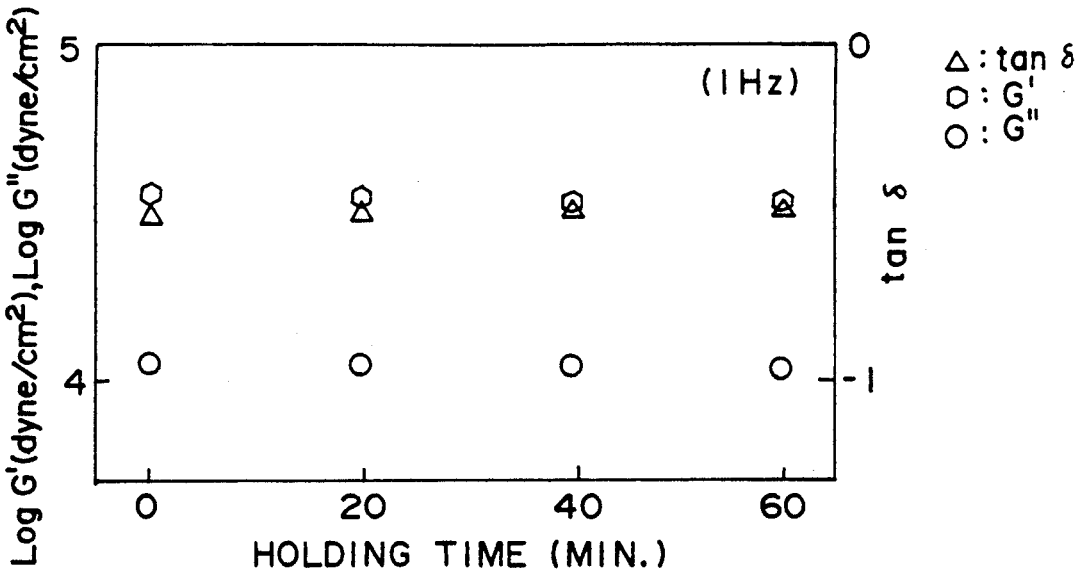
FIGS. 7 and 8 are graphs showing changes with time in viscoelasticity at 200° C., and 0.1 Hz and 1 Hz, respectively, of the toner according to Example 5.
Figure 8:
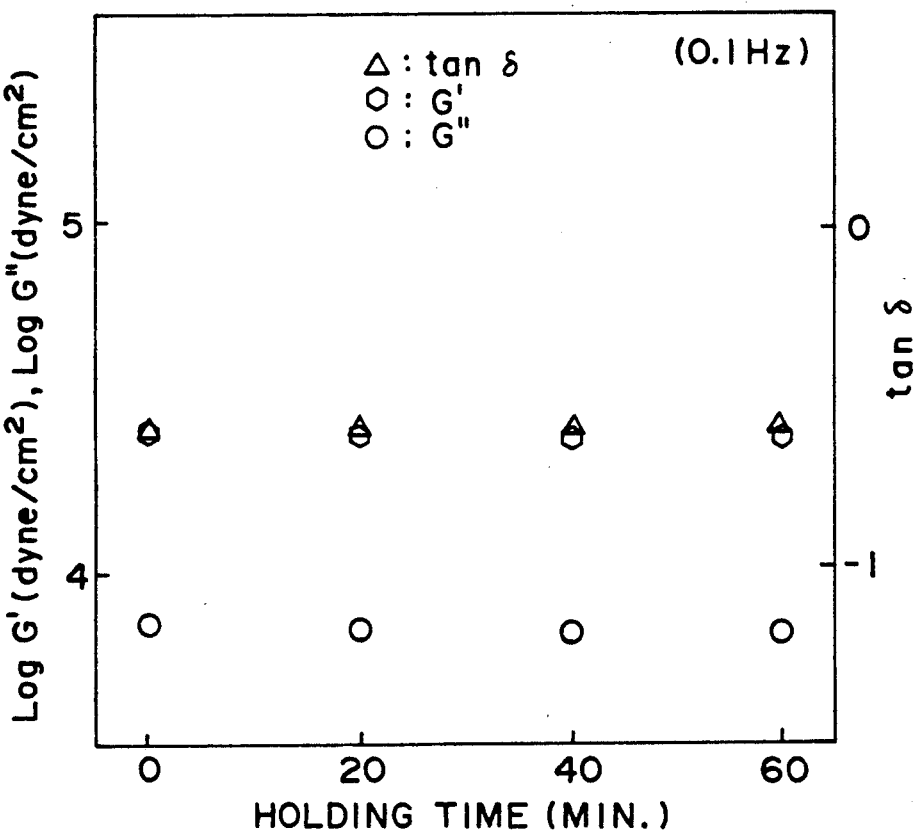

The viscoelastic properties of the magnetic toner were measured at 120° C. and 200° C., and the results thereof are shown in FIGS. 5 and 6, respectively. As shown in these figures, the dynamic modulus G' and loss modulus G'' were within the range of $2\times10^3$–$5\times10^5$ dyne/cm$^2$ from 120° C. to 200° C., and the ratio $G'_{120}/G'_{200}$ was below 40. Further, the viscoelastic properties were not substantially changed with time at 200° C. as shown in FIGS. 7 and 8. The viscoelastic data of the toner are also shown in Table 4 appearing hereinafter together with those of other Examples.

The magnetic toner was evaluated for image formation by using a printer prepared by remodeling a commercially available small-size laser beam printer ("LBP-8II", made by Canon K.K.) so as to form a latent image with minute spots of down to 50 microns by improving the scanner part and to provide a printing speed of 16 sheets (A4-vertical)/min. The evaluation was performed with respect to the initial image quality and fixability, and anti-offset characteristic and staining of hot fixing rollers after 5000 sheets of printing similarly as in Example 1.

Figure 9:
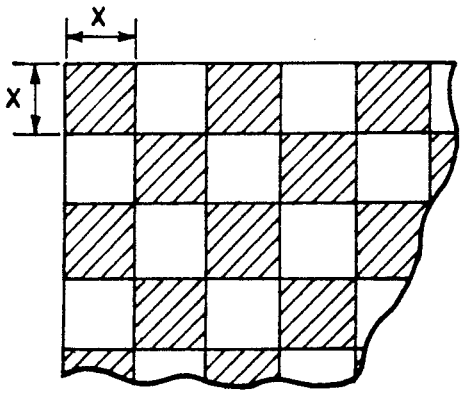
FIG. 9 is an illustration of a checker pattern for evaluating reproducibility of minute dots.

The minute dot reproducibility represents the reproducibility of a checker pattern as shown in FIG. 9 including 100 units square dots each having one side X measuring 80 microns or 50 microns. The reproducibility was evaluated through a microscope while noticing the clarity (presence or absence of defects) and scattering to the non-image parts.

EXAMPLE 6–8

Magnetic toners were prepared in the same manner as in Example 5 except that the resins and metal complexes were formulated as shown in Table 4. The particle seize distribution data of the magnetic toners thus prepared are shown in Table 3, the viscoelastic data are shown in Table 4, and the results of evaluation are shown in Table 5.

EXAMPLE 9

A magnetic toner having a particle size distribution as shown in Table 3 was prepared similarly as in Example 5 while reducing the amount of the magnetic material to 80 wt. parts. The magnetic toner in an amount of 100 wt. parts was dry-blended with 0.8 wt. part of colloidal silica fine powder to obtain a magnetic toner for evaluation. The viscoelastic data of the magnetic toner are shown in Table 4, and the results of evaluation are shown in Table 5.

COMPARATIVE EXAMPLE 4–6

Magnetic toners were prepared in the same manner as in Example 5 except that the resins and metal complexes were formulated as shown in Table 4. The particle size distribution data of the magnetic toners thus prepared are shown in Table 3, the viscoelastic data are shown in Table 4, and the results of evaluation are shown in Table 5.

TABLE 3

| | Particle size distribution of toner | | | | |
|---|---|---|---|---|---|
| toner | % by number of particles of ≦5 μm | % by volume of particles of ≧12.7 μm | % by number of particles of 6.35–10.08 μm | Volume-average particle size (μm) | (% by number)/(% by volume) of particles of ≦5 μm |
| Ex. 5 | 49.2 | 0 | 22.6 | 6.5 | 2.5 |
| 6 | 49.4 | 0 | 22.9 | 6.6 | 2.6 |
| 7 | 49.1 | 0 | 23.0 | 6.6 | 2.5 |
| 8 | 49.1 | 0 | 22.8 | 6.6 | 2.5 |
| 9 | 30.1 | 1.4 | 45.5 | 7.9 | 3.8 |
| Comp. Ex. 4 | 49.0 | 0 | 22.9 | 6.6 | 2.5 |
| 5 | 49.4 | 0 | 22.7 | 6.5 | 2.6 |
| 6 | 49.2 | 0 | 22.5 | 6.5 | 2.5 |

TABLE 4

| | Formulation | | Viscoelastic data | | | |
|---|---|---|---|---|---|---|
| | Binder resin | Organic metal complex | $G'_{120MAX}$ | $G'_{200\,Min}$ | $G'_{120Max}/G'_{200Min}$ | a |
| Ex. 5 | Syn. Ex. 1 100 parts | [I]-2 0.5 part | $2.0\times10^5$ | $1.7\times10^4$ | 12 | 0.16 |
| Ex. 6 | Syn. Ex. 2 100parts | [II]-1 0.8 part | $1.2\times10^5$ | $1.2\times10^4$ | 10 | 0.19 |
| Ex. 7 | Syn. Ex. 3 100 parts | [I]-2 0.5 part | $4.5\times10^5$ | $1.4\times10^4$ | 32 | 0.13 |
| Ex. 8 | Syn. Ex. 1 100 parts | [I]-1 0.4 part [II]-1 0.4 part | $2.0\times10^5$ | $3.8\times10^4$ | 5.2 | 0.13 |
| Ex. 9 | Syn. Ex. 1 | [I]-2 | $2.0\times10^5$ | $1.8\times10^4$ | 11 | 0.16 |

TABLE 4-continued

| | Formulation | | Viscoelastic data | | | |
|---|---|---|---|---|---|---|
| | Binder resin | Organic metal complex | $G'_{120MAX}$ | $G'_{200\,Min}$ | $G'_{120Max}/G'_{200Min}$ | a |
| | 100 parts | 0.5 part | | | | |
| Comp. Ex. 4 | Comp. Syn. Ex. 1 100 parts | [I]-2 0.5 part | $1.8 \times 10^5$ | $2.9 \times 10^2$ | 620 | 0.35 |
| Comp. Ex. 5 | Comp. Syn. Ex. 2 100 parts | [I]-2 0.5 part | $1.8 \times 10^5$ | $1.0 \times 10^3$ | 180 | 0.30 |
| Comp. Ex. 6 | Comp. Syn. Ex. 3 100 parts | [I]-2 0.5 part | $2.0 \times 10^5$ | $5.7 \times 10^2$ | 350 | 0.35 |

TABLE 5

| | Fixability | Anti-offset | Pulver-ization *1 | Roller stain *2 | Dmax *3 | Dot reproducibility 80 μm | Dot reproducibility 50 μm |
|---|---|---|---|---|---|---|---|
| Ex. 5 | ○ | ○ | ○ | ○ | 1.37 | ○ | ○ |
| 6 | ○ | ○ | ○ | ○ | 1.32 | ○ | ○ |
| 7 | ○ | ○ | ○ | ○ | 1.33 | ○ | ○ |
| 8 | ○ | ○ | ○ | ○ | 1.32 | ○ | ○ |
| 9 | ○ | ○ | ○ | ○ | 1.35 | ○ | ○Δ |
| Comp. Ex. 4 | Δ | x | ○ | x | 1.36 | ○ | ○ |
| 5 | x | Δ | x | Δ | 1.35 | ○ | ○ |
| 6 | x | Δ | x | ○Δ | 1.32 | ○ | ○ |

*1: Pulverizability of kneaded product.
*2: Hot fixing roller stain (after 5000 sheets)
*3: Image density Dmax at the initial stage (after 20 sheets)

What is claimed is:

1. A heat and pressure fixable toner for developing electrostatic images, comprising: a binder resin and a metal salt or a metal complex; wherein the toner has:

a dynamic modulus $G'_{120-200}$ at 120–200° C. of $2\times10^3$ or higher to below $5\times10^5$ [dyne/cm$^2$] as measured in the frequency range of $1\times10^{-2}$–1 (Hz);

a loss modulus $G''_{120-200}$ at 120–200° C. of $2\times10^3$ or higher to below $5\times10^5$ [dyne/cm$^2$] as measured in the frequency range of $1\times10^{-2}$–1 (Hz);

a dynamic modulus $G'_{200}$ at 200° C. and a frequency f satisfying an approximated linear relationship according to the least squares method of:

$$\log G'_{200} = a \cdot \log f + \log b,$$

wherein a denotes a positive number of 0.25 or smaller and b denotes a constant; and a ratio $(G'_{200})/(G'_{120})$ of below 0.25 wherein $(G'_{200})$ denotes a dynamic modulus at 200° C. and $(G'_{120})$ denotes a dynamic modulus at 120° C. respectively at a frequency of 1 (Hz);

wherein the binder resin comprises a copolymer or a mixture thereof comprising polymerized units of a carboxyl group-containing monomer and having crosslinkages including a metallic crosslinkage and a polymeric crosslinkage.

2. The toner according to claim 1, which contains a magnetic material.

3. The toner according to claim 1, wherein the positive number a is 0.05 to below 0.25.

4. The toner according to claim 1, wherein the binder resin shows a molecular weight distribution on its GPC chromatogram including at least one peak in the molecular weight range of 2000 to below 15,000 and a peak or shoulder in the molecular weight range of 15,000 to 100,000.

5. The toner according to claim 1, wherein the binder resin shows a JIS acid value (A) and total acid value (B) giving a ratio A/B in the range of 0.75–0.99.

6. The toner according to claim 1, wherein the binder resin contains 5–70 wt. % of a THF-insoluble content.

7. The toner according to claim 1, wherein the binder resin contains 20–60 wt. % of a THF-insoluble content.

8. The toner according to claim 1, wherein the toner shows a dynamic modulus and a loss modulus measured while it is held at 200° C. for a period of one hour, which are within the range of 0.8–1.8 times the corresponding values measured at the initial stage of the period.

9. The toner according to claim 1, wherein the toner shows a dynamic modulus and loss a modulus measured while it is held at 200° C. for a period of one hour, which are within the range of 0.9–1.5 times the corresponding values measured at the initial stage of the period.

10. The toner according to claim 1, wherein the binder resin has been melt-kneaded with the metal salt or metal complex.

11. The toner according to claim 1, wherein the binder resin comprises a styrene-α,β-unsaturated dicarboxylic acid-α,β-unsaturated dicarboxylic anhydride copolymer.

12. The toner according to claim 1, wherein the binder resin comprises a styrene-α,β-unsaturated dicarboxylic acid-α,β-unsaturated dicarboxylic anhydride copolymer, and a styrene-acrylic acid ester-α,β-unsaturated dicarboxylic acid half-ester copolymer.

13. The toner according to claim 12, wherein the binder resin contains 1–30 wt. % of polymerized units of an α,β-unsaturated dicarboxylic acid half-ester monomer.

14. The toner according to claim 12, wherein the binder resin contains 3–20 wt. % of polymerized units of an $\alpha,\beta$-unsaturated dicarboxylic acid half-ester monomer.

15. The toner according to claim 12, wherein the styrene-acrylic acid ester-$\alpha,\beta$-unsaturated dicarboxylic acid half-ester copolymer is crosslinked with a crosslinking monomer.

16. The toner according to claim 15, wherein the crosslinking monomer is divinylbenzene.

17. The toner according to claim 1, wherein the metal salt comprises an organic metal salt.

18. The toner according to claim 1, wherein the metal complex comprises an organic metal complex.

19. The toner according to claim 1, wherein the metal complex is an azo metal complex represented by the formula:

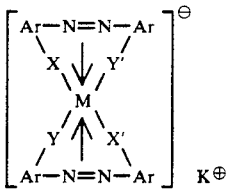

wherein M denotes a coordination center metal having a coordination number of 6; Ar denotes an aryl group capable of having a substituent selected from nitro, halogen, carboxyl, anilide, and alkyl and alkoxy having 1-18 carbon atoms; X, X', Y and Y' independently denote —O—, —CO—, —NH—, or —NH— (wherein R denotes an alkyl having 1-4 carbon atoms; and K⊕ denotes hydrogen, sodium, potassium, ammonium or aliphatic ammonium.

20. The toner according to claim 1, wherein the metal complex is an organic metal complex represented by the formula:

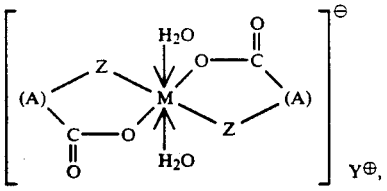

wherein M denotes a coordination center metal having a coordination number of 6; A denotes

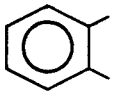

(capable of having a substituent),

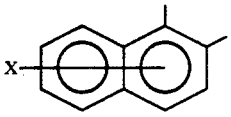

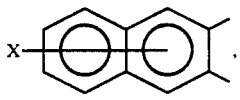

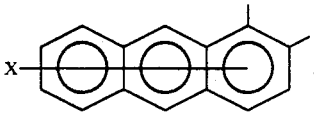

-continued

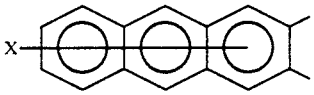

(X denotes hydrogen, halogen, or nitro),

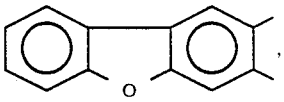

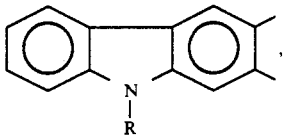

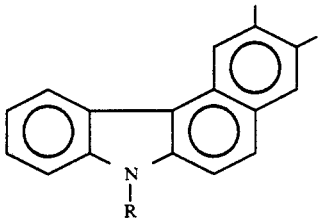

(R denotes hydrogen, $C_1$-$C_{18}$ alkyl or $C_1$-$C_{18}$ alkenyl); Y⊕ denotes hydrogen, sodium, potassium, ammonium, or aliphatic ammonium; and Z denotes —O— or —CO-.O—.

21. The toner according to claim 1, wherein the metal complex is used in a proportion of 0.01-10 wt. parts per 100 wt. parts of the binder resin.

22. The toner according to claim 1, wherein the metal complex is used in a proportion of 0.1-5 wt. parts per 100 wt. parts of the binder resin.

23. The toner according to claim 1, wherein the metal complex is used in a proportion of 1-5 wt. parts per 100 wt. parts of the binder resin.

24. The toner according to claim 1, which contains 20-140 wt. parts of a magnetic material per 100 wt. parts of the binder resin.

25. The toner according to claim 1, which contains 30-120 wt. parts of a magnetic material per 100 wt. parts of the binder resin.

26. The toner according to claim 1, which comprises a magnetic toner having a volume-average particle size of 4.5-8 microns.

27. The toner according to claim 1, which comprises a magnetic toner having a volume-average particle size of 6-8 microns.

28. The toner according to claim 26, wherein the magnetic toner has such a particle size distribution that it contains 17-60% by number of magnetic toner particles of 5 microns or smaller, 5-50% by number of magnetic toner particles of 6.35-10.08 microns, and 2.0% by volume or less of magnetic toner particles of 12.7 microns or larger and satisfies the condition of $N/V=-0.05N+k$ . . . (1), wherein N is a number of 17-60 denoting the content in terms of % by number of the toner particles of 5 microns or smaller, V is a number denoting the content in terms of % by volume of the toner particles of 5 microns or smaller, and k is a number of 4.6-6.7.

29. A fixing method comprising fixing a toner image on a sheet by applying heat and pressure, wherein the toner comprises a binder resin and a metal salt or a metal complex;

wherein the toner has:

a dynamic modulus $G'_{120-200}$ at 120–200° C. of $2\times10^3$ or higher to below $5\times10^5$ [dyne/cm$^2$] as measured in the frequency range of $1\times10^{-2}$–1 (Hz);

a loss modulus $G''_{120-200}$ at 120–200° C. of $2\times10^3$ or higher to below $5\times10^5$ [dyne/cm$^2$] as measured in the frequency range of $1\times10^{-2}$–1 (Hz);

a dynamic modulus $G'_{200}$ at 200° C. and a frequency f satisfying an approximated linear relationship according to the least squares method of:

$$\log G'_{200} = a\cdot\log f + \log b.$$

wherein a denotes a positive number of 0.25 or smaller and b denotes a constant; and a ratio $(G'_{200})/G'_{120})$ of below 0.25 wherein $(G'_{200})$ denotes a dynamic modulus at 200° C. and $(G'_{120})$ denotes a dynamic modulus at 120° C. respectively at a frequency of 1 (Hz); and wherein the binder resin comprises a copolymer or a mixture thereof comprising polymerized units of a carboxyl group-containing monomer and having crosslinkages including a metallic crosslinkage and a polymeric crosslinkage.

30. The method according to claim 29, including fixing the toner on a sheet by a hot pressure roller.

31. The method according to claim 30, including employing a cleaning pad on the hot pressure roller fixer.

32. The method according to claim 29, wherein the toner contains a magnetic material.

33. The method according to claim 29, wherein the positive number a is 0.05 to below 0.25.

34. The method according to claim 29, wherein the binder resin shows a molecular weight distribution on its GPC chromatogram including at least one peak in the molecular weight range of 2000 to below 15,000 and a peak or shoulder in the molecular weight range of 15,000 to 100,000.

35. The method according to claim 29, wherein the binder resin shows JIS acid value (A) and total acid value (B) giving a ratio A/B in the range of 0.75–0.99.

36. The method according to claim 29, wherein the binder resin contains 5–70 wt. % of a THF-insoluble content.

37. The method according to claim 29, wherein the binder resin contains 20–60 wt. % of a THF-insoluble content.

38. The method according to claim 29, wherein the toner shows a dynamic modulus and a loss modulus measured while it is held at 200° C. for a period of one hour, which are within the range of 0.8–1.8 times the corresponding values measured at the initial stage of the period.

39. The method according to claim 29, wherein the toner shows a dynamic modulus and a loss modulus measured while it is held at 200° C. for a period of one hour, which are within the range of 0.9–1.5 times the corresponding values measured at the initial stage of the period.

40. The method according to claim 29, wherein the binder resin has been melt-kneaded with the metal salt or metal complex.

41. The method according to claim 29, wherein the binder resin comprises a styrene-α,β-unsaturated dicarboxylic acid-α,β-unsaturated dicarboxylic anhydride copolymer.

42. The method according to claim 29, wherein the binder resin comprises a styrene-α,β-unsaturated dicarboxylic acid-α,β-unsaturated dicarboxylic anhydride copolymer, and a styrene-acrylic acid ester-α,β-unsaturated dicarboxylic acid half-ester copolymer.

43. The method according to claim 42, wherein the binder resin contains 1–30 wt. % of polymerized units of an α,β-unsaturated dicarboxylic acid half-ester monomer.

44. The method according to claim 42, wherein the binder resin contains 3–20 wt. % of polymerized units of an α,β-unsaturated dicarboxylic acid half-ester monomer.

45. The method according to claim 29, wherein the styrene-acrylic acid ester-α,β-unsaturated dicarboxylic acid half-ester copolymer is crosslinked with a crosslinking monomer.

46. The method according to claim 45, wherein the crosslinking monomer is divinylbenzene.

47. The method according to claim 29, wherein the metal salt comprises an organic metal salt.

48. The method according to claim 29, wherein the metal complex comprises an organic metal complex.

49. The method according to claim 29, wherein the metal complex is an azo metal complex represented by the formula:

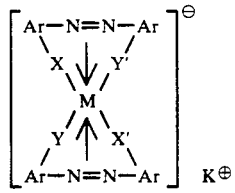

wherein M is a coordination center metal having a coordination number of 6; Ar is an unsubstituted aryl group or an aryl group substituted with a substituent selected from the group consisting of nitro, halogen, carboxyl, anilide, and alkyl and alkoxy having 1–18 carbon atoms; X, X', Y and Y' independently are —O—, —CO—, —NH—, or —NR— wherein R is an alkyl having 1–4 carbon atoms; and K⊕ is hydrogen, sodium, potassium, ammonium or aliphatic ammonium.

50. The method according to claim 29, wherein the metal complex is an organic metal complex represented by the formula:

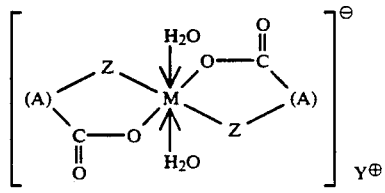

wherein M is a coordination center metal having a coordination number of 6; A denotes

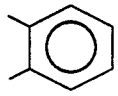

which is substituted or unsubstituted:

-continued

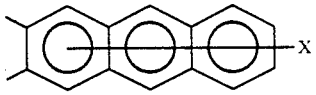

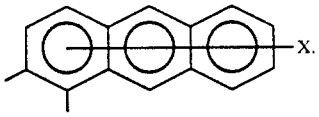

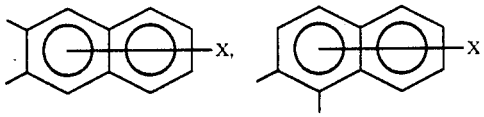

wherein X is hydrogen, halogen, or nitro,

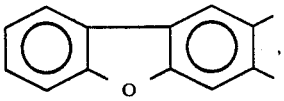

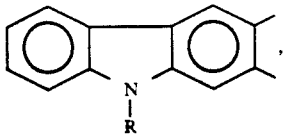

-continued

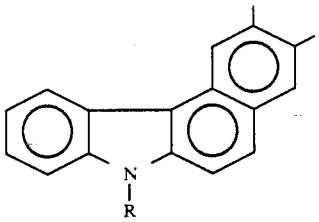

R is hydrogen, $C_1$–$C_{18}$ alkyl or $C_1$–$C_{18}$ alkenyl; $Y\oplus$ is hydrogen, sodium, potassium, ammonium, or aliphatic ammonium; and Z is —O— or —CO.O—.

51. The method according to claim 29, wherein the metal complex is used in a proportion of 0.01–10 wt. parts per 100 wt. parts of the binder resin.

52. The method according to claim 29, wherein the metal complex is used in a proportion of 0.1–5 wt. parts per 100 wt. parts of the binder resin.

53. The method according to claim 29, wherein the metal complex is used in a proportion of 1–5 wt. parts per 100 wt. parts of the binder resin.

54. The method according to claim 29, which contains 20–140 wt. parts of a magnetic material per 100 wt. parts of the binder resin.

55. The method according to claim 29, which contains 30–120 wt. parts of a magnetic material per 100 wt. parts of the binder resin.

56. The method according to claim 29, which comprises a magnetic toner having a volume-average particle size of 4.5–8 microns.

57. The method according to claim 29, which comprises a magnetic toner having a volume-average particle size of 6–8 microns.

58. The method according to claim 56, wherein the magnetic toner has such a particle size distribution that it contains 17–60% by number of magnetic toner particles of 5 microns or smaller, 5–50% by number of magnetic toner particles of 6.35–10.08 microns, and 2.0% by volume or less of magnetic toner particles of 12.7 microns or larger and satisfies the condition of $N/V = -0.05N + k$ . . . (1), wherein N is a number of 17–60 denoting the content in terms of % by number of the toner particles of 5 microns or smaller, V is a number denoting the content in terms of % by volume of the toner particles of 5 microns or smaller, and k is a number of 4.6–6.7.

* * * * *

UNITED STATES PATENT AND TRADEMARK OFFICE

CERTIFICATE OF CORRECTION

PATENT NO. : 5,180,649

DATED : January 19, 1993

INVENTOR(S) : TSUTOMU KUKIMOTO, ET AL.

It is certified that error appears in the above-identified patent and that said Letters Patent is hereby corrected as shown below:

COLUMN 1

Line 29, "as" should read --an--.
Line 53, "a" should be deleted.
Line 54, "very" should read --a very--.

COLUMN 2

Line 22, "improved an" should read --an improved--.
Line 23, "characteristic" should read --characteristic,--.
Line 61, "$10^3$14 $8\times10^4$" should read --$10^3$-$8\times10^4$--,

COLUMN 3

Line 31, "gellation" should read --gelation--.

COLUMN 8

Line 58, "15,000-10,000," should read --15,000-100,000,--.
Line 62, "100,000" should read --15,000-100,000--.

COLUMN 9

Line 34, "be" should read --to be--.
Line 63, "measure" should read --measured--.

COLUMN 10

Line 55, "damage" should read --damaged--.

UNITED STATES PATENT AND TRADEMARK OFFICE

CERTIFICATE OF CORRECTION

PATENT NO. : 5,180,649

DATED : January 19, 1993

INVENTOR(S) : TSUTOMU KUKIMOTO, ET AL.

It is certified that error appears in the above-identified patent and that said Letters Patent is hereby corrected as shown below:

COLUMN 11

Line 6, "ratio A/B" should read --ratio (A/B)--.
Line 8, "instable," should read --unstable,--.
Line 14, "4 hours of" shoudl be deleted.
Line 54, "solved In" should read --solved. In--.

COLUMN 14

Line 35, "(4-hydroxyphenyl)propanediacrylate," should read --(4-hydroxyphenyl)-propanediacrylate,--.

COLUMN 16

Line 8, "atoms;" should read --atoms);--.

COLUMN 22

Line 67, "toners" should read --toner's--.

COLUMN 23

Line 43, "(If" should read --If--.

COLUMN 25

Line 63, "received" should read --received from--.

COLUMN 26

Line 62, "nitrogen. The" should read --nitrogen, the--.

UNITED STATES PATENT AND TRADEMARK OFFICE

CERTIFICATE OF CORRECTION

PATENT NO. : 5,180,649

DATED : January 19, 1993

INVENTOR(S) : TSUTOMU KUKIMOTO, ET AL.

It is certified that error appears in the above-identified patent and that said Letters Patent is hereby corrected as shown below:

COLUMN 27

Line 16, "minutes The" should read --minutes. The--.
Line 25, "ASTM D 341-82" should read --ASTM D 3418-82--.

COLUMN 29

Line 53, "1.0 wt. parts" should read --1.0 wt. part--.

COLUMN 31

Line 53, "back standing" should read --back-staining--.

COLUMN 32

Line 10, "EXAMPLE 2-4," should read --EXAMPLES 2-4,--.
Line 60, "3 wt. part" should read --3 wt. parts--.

COLUMN 34

Line 10, "EXAMPLE 6-8" should read --EXAMPLES 6-8--.
Line 14, "seize" should read --size--.
Line 30, "EXAMPLE 4-6" should read --EXAMPLES 4-6--.

TABLE 3, "toner Ex. 5" should read --Toner Ex. 5--.

COLUMN 37

Line 32, "or —NH—" should read --or —NR— --.

UNITED STATES PATENT AND TRADEMARK OFFICE

CERTIFICATE OF CORRECTION

PATENT NO. : 5,180,649

DATED : January 19, 1993

INVENTOR(S) : TSUTOMU KUKIMOTO, ET AL.

It is certified that error appears in the above-identified patent and that said Letters Patent is hereby corrected as shown below:

COLUMN 39

Line 19, "$(G'_{200})/G'_{120})$" should read --$(G'_{200})/(G'_{120})$--.
Line 44, "shows" should read --shows a--.

Signed and Sealed this

Eighth Day of March, 1994

Bruce Lehman

*Attest:*

BRUCE LEHMAN

*Attesting Officer*

*Commissioner of Patents and Trademarks*